US009733609B2

(12) United States Patent
Koyama et al.

(10) Patent No.: US 9,733,609 B2
(45) Date of Patent: Aug. 15, 2017

(54) IMAGE FORMING DEVICE PROVIDED WITH FIRST AND SECOND DISCHARGE ROLLERS

(71) Applicant: Brother Kogyo Kabushiki Kaisha, Nagoya-shi, Aichi-ken (JP)

(72) Inventors: Tatsuya Koyama, Toyoake (JP); Yusuke Ikegami, Nagoya (JP); Shogo Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/047,022

(22) Filed: Feb. 18, 2016

(65) Prior Publication Data

US 2016/0246235 A1 Aug. 25, 2016

(30) Foreign Application Priority Data

Feb. 25, 2015 (JP) ..... 2015-035053
Feb. 25, 2015 (JP) ..... 2015-035054
Feb. 25, 2015 (JP) ..... 2015-035056

(51) Int. Cl.
*G03G 21/16* (2006.01)
*G03G 15/00* (2006.01)

(52) U.S. Cl.
CPC ..... *G03G 21/1633* (2013.01); *G03G 15/6573* (2013.01); *G03G 21/1604* (2013.01);
(Continued)

(58) Field of Classification Search
CPC ..... G03G 2215/00004; G03G 2215/00008; G03G 2215/00012; G03G 15/6573;
(Continued)

(56) References Cited

U.S. PATENT DOCUMENTS 4,456,362 A * 6/1984 Masaki ..... G03G 21/1695 294/138
4,803,510 A * 2/1989 Maeda ..... G03G 21/1814 399/114
(Continued)

FOREIGN PATENT DOCUMENTS

JP H02-072986 A 3/1990
JP H04-102859 A 4/1992
(Continued)

*Primary Examiner* — Justin Olamit
(74) *Attorney, Agent, or Firm* — Banner & Witcoff, Ltd.

(57) ABSTRACT

An image forming device includes first and second discharge rollers, and first and second covers. The first cover is pivotally movable between first closing and opening positions about a first pivot axis. In the first opening position, the first cover supports a sheet from the first discharge roller. The second cover is pivotally movable between second closing and opening positions about a second pivot axis. In the second opening position, the second cover guides a sheet from the second discharge roller. In the first closing position, one end portion of the first cover is farther from the second cover. In the second closing position, another end portion of the second cover is farther from the first cover. The first pivot axis is at the one end portion of the first cover. The second pivot axis is at the another end portion of the second cover.

19 Claims, 17 Drawing Sheets

(52) U.S. Cl.
CPC ..... *G03G 2215/00004* (2013.01); *G03G 2215/00016* (2013.01)

(58) Field of Classification Search
CPC ..... G03G 21/1604; G03G 21/1609; G03G 21/1623; G03G 21/1628; G03G 21/1633; G03G 21/1638; G03G 2215/00016; B65H 2402/44; B65H 2402/441; B65H 2402/45
See application file for complete search history.

(56) References Cited

U.S. PATENT DOCUMENTS

| | | | | |
|---|---|---|---|---|
| 4,945,364 | A | 7/1990 | Maruyama et al. | |
| 5,039,585 | A | 8/1991 | Rule et al. | |
| 5,567,068 | A * | 10/1996 | Egashira | B41J 13/00 271/278 |
| 7,343,124 | B2 * | 3/2008 | Uehara | G03G 15/6502 399/299 |
| 7,636,528 | B2 * | 12/2009 | Sato | G03G 15/00 399/107 |
| 8,600,284 | B2 | 12/2013 | Sato et al. | |
| 8,744,305 | B2 | 6/2014 | Niikawa | |
| 8,977,185 | B2 * | 3/2015 | Sato | 399/25 |
| 9,069,316 | B2 | 6/2015 | Saeki | |
| 9,083,831 | B2 | 7/2015 | Niikawa | |
| 2006/0083564 | A1 | 4/2006 | Yazawa et al. | |
| 2006/0221170 | A1 | 10/2006 | Sato et al. | |
| 2007/0196157 | A1 | 8/2007 | Matsushima et al. | |
| 2008/0240817 | A1 | 10/2008 | Sato et al. | |
| 2008/0247793 | A1 | 10/2008 | Sato et al. | |
| 2010/0315658 | A1 | 12/2010 | Niikawa | |
| 2014/0086659 | A1 | 3/2014 | Sato et al. | |
| 2014/0153976 | A1 | 6/2014 | Saeki | |
| 2014/0293359 | A1 | 10/2014 | Niikawa | |

FOREIGN PATENT DOCUMENTS

| | | | |
|---|---|---|---|
| JP | H04-339678 | A | 11/1992 |
| JP | H05-077507 | A | 3/1993 |
| JP | H05-070958 | U | 9/1993 |
| JP | H06-143743 | A | 5/1994 |
| JP | H09-091117 | A | 4/1997 |
| JP | 2001-213022 | A | 8/2001 |
| JP | 2002-052783 | A | 2/2002 |
| JP | 2004-106988 | A | 4/2004 |
| JP | 2005-119858 | A | 5/2005 |
| JP | 2006-205377 | A | 8/2006 |
| JP | 2006-276775 | A | 10/2006 |
| JP | 2006-276777 | A | 10/2006 |
| JP | 2007-281955 | A | 10/2007 |
| JP | 2007-298710 | A | 11/2007 |
| JP | 2007-310017 | A | 11/2007 |
| JP | 2008-060399 | A | 3/2008 |
| JP | 2008-250028 | A | 10/2008 |
| JP | 2008-250045 | A | 10/2008 |
| JP | 2011-018038 | A | 1/2011 |
| JP | 2013-010592 | A | 1/2013 |
| JP | 2014-108857 | A | 6/2014 |
| JP | 2014-115573 | A | 6/2014 |
| JP | 2014-209205 | A | 11/2014 |

* cited by examiner

IMAGE FORMING DEVICE PROVIDED WITH FIRST AND SECOND DISCHARGE ROLLERS

CROSS REFERENCE TO RELATED APPLICATION

This application claims priorities from Japanese Patent Application Nos. 2015-035053, 2015-035054, and 2015-035056, those filed Feb. 25, 2015. The entire content of the priority applications is incorporated herein by reference.

TECHNICAL FIELD

The present disclosure relates to an image forming device in which two sets of discharge rollers are provided at an upper portion of an interior of a housing.

BACKGROUND

Japanese Patent Application Publication No. 2008-250028 discloses an image forming device in which a sheet is inserted in a vertical orientation into a housing through a supply opening formed at an upper wall of the housing, and a sheet is discharged through a discharge opening formed at the upper wall of the housing.

SUMMARY

There is a demand that a sheet conveyer passage in the housing be changed dependent on a thickness of the sheet. To meet this demand, two discharge openings may be formed at an upper wall of the housing. In this case, a user is less likely to notice the discharged sheet when discharging direction of a sheet discharged through one discharge opening is different from discharging direction of a sheet discharged through the other discharge opening.

It is therefore an object of the present disclosure to provide an image forming device facilitating access to the discharged sheet.

This and other objects will be attained by providing an image forming device including a housing, a first discharge roller, a second discharge roller, a first cover and a second cover. The first discharge roller is disposed at an upper portion of an interior of the housing and is configured to discharge a sheet out of the housing. The second discharge roller is disposed at the upper portion of the interior of the housing and is configured to discharge a sheet out of the housing. The second discharger roller has a part overlapped with the first discharge roller in a perpendicular direction perpendicular to an axial direction of the first discharge roller and to a vertical direction. The first cover is pivotally movable relative to the housing about a first pivot axis extending in the axial direction between a first closing position and a first opening position. The first cover is positioned above the first discharge roller and constitutes a part of an upper surface of the housing when the first cover is at the first closing position. The first cover is configured to allow the first discharge roller to be exposed to an outside and to support the sheet discharged from the first discharge roller when the first cover is at the first opening position. The second cover is pivotally movable relative to the housing about a second pivot axis extending in the axial direction between a second closing position and a second opening position. The second cover is configured to cover an upper portion of the second discharge roller and constitutes the upper surface of the housing next to the first cover positioned at the first closing position when the second cover is at the second closing position. The second cover is configured to allow the second discharge roller to be exposed to the outside and to guide the sheet discharged from the second discharge roller when the second cover is at the second opening position. The first cover has one end portion and another end portion in the perpendicular direction, and the second cover has one end portion and another end portion in the perpendicular direction. The one end portion of the first cover is positioned farther from the second cover than the another end portion of the first cover from the second cover when the first cover is at the first closing position. The another end portion of the second cover is positioned farther from the first cover than the one end portion of the second cover from the first cover when the second cover is at the second closing position. The first pivot axis is positioned at the one end portion of the first cover, and the second pivot axis is positioned at the another end portion of the second cover.

BRIEF DESCRIPTION OF THE DRAWINGS

The particular features and advantages of the disclosure as well as other objects will become apparent from the following description taken in connection with the accompanying drawings, in which.

DETAILED DESCRIPTION

A laser printer 1 as an example of an image forming apparatus according to embodiments will be described while referring to the accompanying drawings. Directions in the following description such as "frontward/rearward", "leftward/rightward", and "upward/downward" will be based on an assumption that the laser printer 1 is disposed in an orientation in which it is intended to be used.

Figure 1:
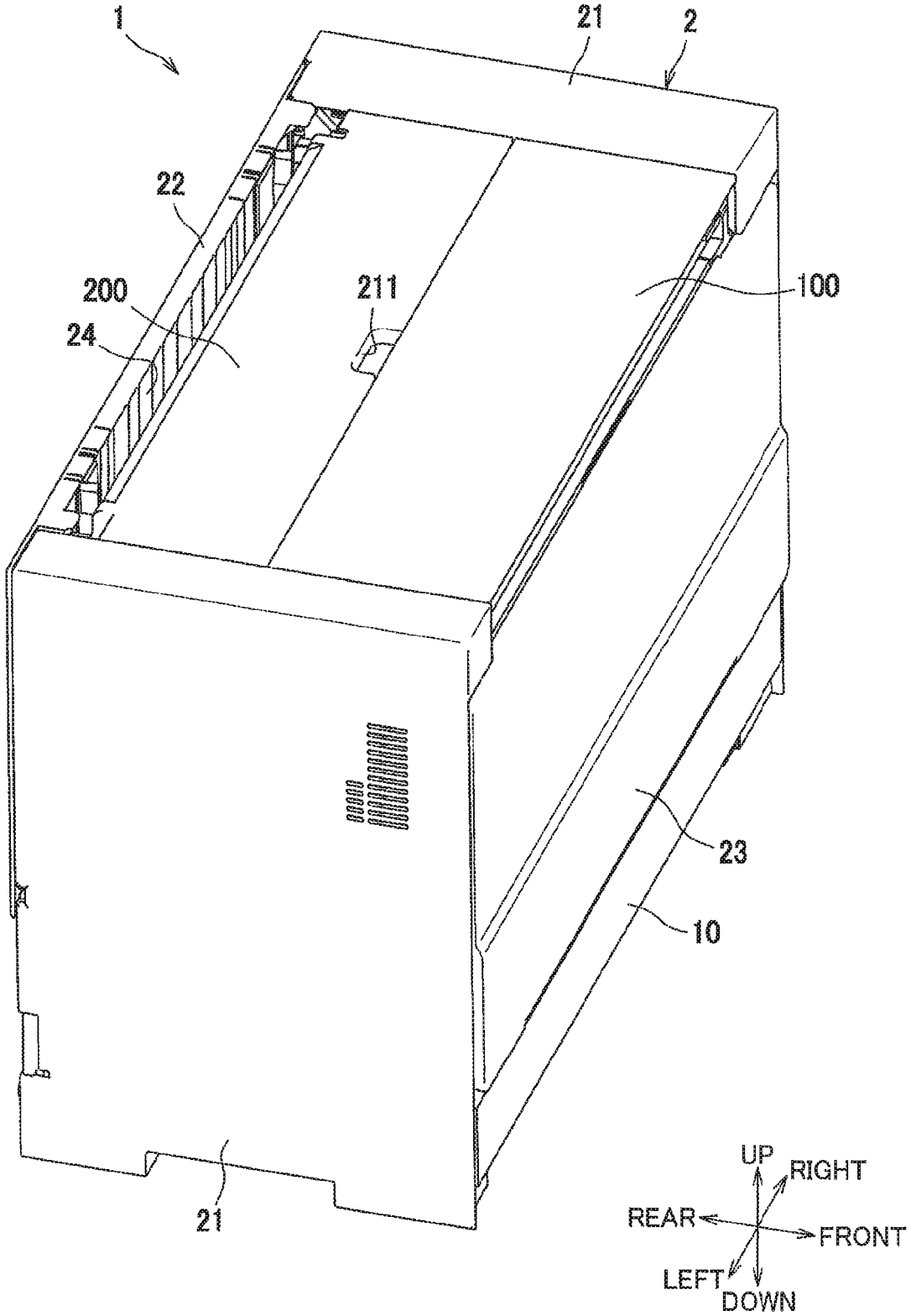
FIG. 1 is a perspective view of a laser printer according to one embodiment.
Figure 2:
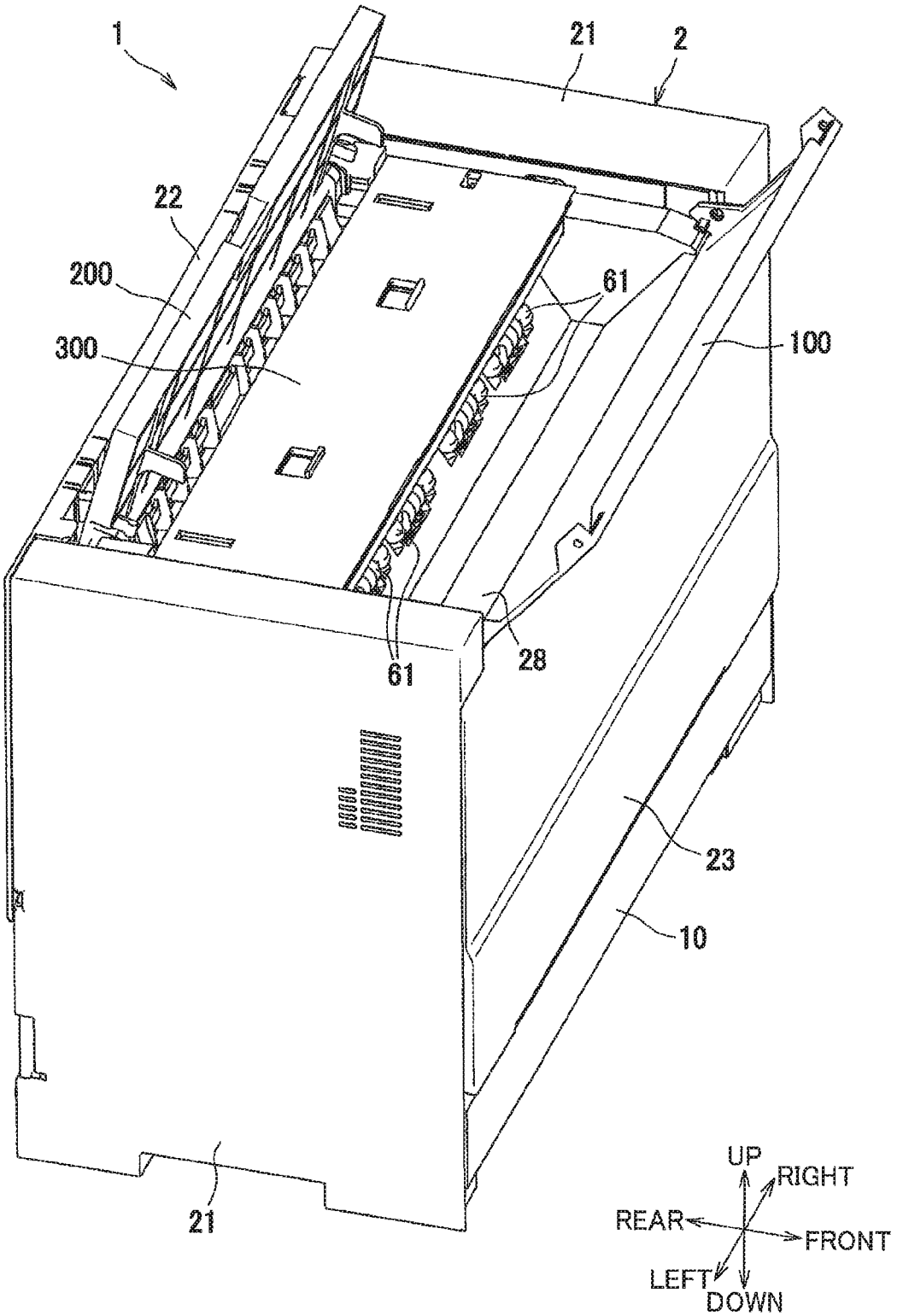
FIG. 2 is a perspective view of the laser printer in which a first outer cover and a second outer cover are open.

As illustrated in FIGS. 1 and 2, the laser printer 1 includes a housing 2, a first outer cover 100, a second outer cover 200, a lower cover 10, and an inner cover 300. The first outer cover 100 and the second outer cover 200 are provided at an upper portion of the housing 2. The lower cover 10 is provided at a lower portion of a front surface of the housing 2. The inner cover 300 is provided inside the first outer cover 100 and the second outer cover 200. The first outer cover 100 is an example of a first cover. The second outer cover 200 is an example of a second cover. The inner cover 300 is an example of a third cover.

As illustrated in FIG. 1, the housing 2 includes a pair of side walls 21, a rear wall 22, and a front wall 23. The side walls 21 are spaced away from each other in the leftward/rightward direction. Each side wall 21 has a rear end, and each rear end is connected to the rear wall 22. The rear wall 22 has an upper end disposed at the substantially same height as the upper end of the side wall 21. The front wall 23 connects the front ends of the pair of side walls 21. The front wall 23 has an upper end positioned downward of the upper end of the side wall 21 in the upward/downward direction, and a lower end positioned upward of the lower end of the side wall 21 in the upward/downward direction. Then, the upper surfaces of the pair of side walls 21 and the upper surface of the rear wall 22 define a part of the upper surface of the apparatus (the laser printer 1).

Each of the first outer cover 100 and the second outer cover 200 is a rectangular member elongated in the leftward/rightward direction. The first outer cover 100 and the second outer cover 200 are positioned between the pair of side walls 21 and are arrayed in frontward/rearward direction. Specifically, the second outer cover 200 is disposed adjacent to the rear portion of the first outer cover 100.

The housing 2 has an upper surface formed with a first sheet supply opening 24 into which a sheet S is inserted. The first sheet supply opening 24 is positioned at a position adjacent to the rear portion of the second outer cover 200 in the frontward/rearward direction. The first sheet supply opening 24 is an example of a supply opening. The sheet S is an example of a sheet. Specifically, the rear wall 22 and the second outer cover 200 are separated from each other in the frontward/rearward direction, and a space between the rear wall 22 and the second outer cover 200 is formed as the first sheet supply opening 24. The first sheet supply opening 24 is an example of a sheet supply opening.

The lower cover 10 is disposed below the front wall 23. The lower cover is pivotally movable about the lower end thereof between a closing position and an opening position. The closing position (a position of FIG. 1), is a position at which the lower cover 10 forms the front surface of the apparatus along with the front wall 23. The opening position (a position indicated by the two-dotted chain line of FIG. 4) is a position at which the lower cover 10 falls forward. In addition, when the lower cover 10 pivotally moves to the opening position, a second sheet supply opening 25 (see FIG. 4) into which the sheet S is inserted is opened forward. The second sheet supply opening 25 is positioned below the front wall 23 of the housing 2. That is, the housing 2 is formed with the second sheet supply opening 25 at the lower portion of the front portion of the housing 2.

The first outer cover 100 and the second outer cover 200 are formed as so-called hinged double doors.

Specifically, the first outer cover 100 is pivotally movable about a first pivot axis A1 (see FIG. 4) between a first closing position and a first opening position. The first pivot axis A1 extends in the leftward/rightward direction. The first closing position is a position at which the first outer cover 100 forms the upper surface of the apparatus as illustrated in FIG. 1. The first opening position is a position at which the rear end of the first outer cover 100 is pivotally moved upward from the first closing position as illustrated in FIG. 2.

The second outer cover 200 is pivotally movable about the second pivot axis A2 (see FIG. 4) between a second closing position and a second opening position. The second pivot axis A2 extends in the leftward/rightward direction. As illustrated in FIG. 1, the second closing position is a position at which the second outer cover 200 defines the upper surface of the apparatus continuous with the first outer cover 100. As illustrated in FIG. 2, the second opening position is a position at which the second outer cover 200 is pivotally moved upward from the second closing position as illustrated in FIG. 2.

Figure 4:
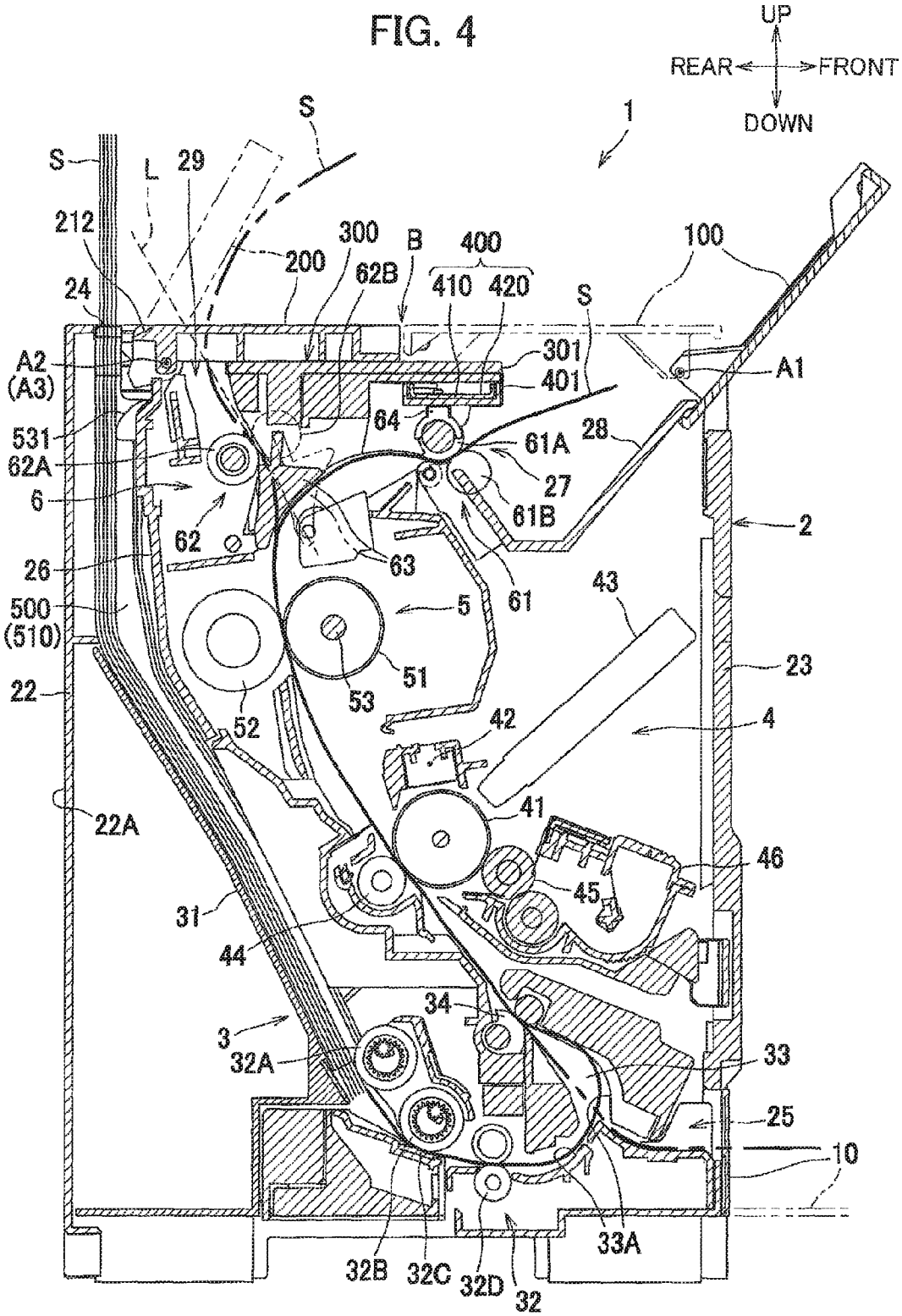
FIG. 4 is a schematic cross-sectional view of the laser printer.

As illustrated in FIG. 4, the first pivot axis A1 of the first outer cover 100 is disposed at one end portion in the frontward/rearward direction remote from the second outer cover 200 of the first outer cover 100, that is, the first pivot axis A1 is disposed at the front end portion of the first outer cover 100 when the first outer cover 100 is positioned at the first closing position.

Further, the second pivot axis A2 of the second outer cover 200 is disposed at the other end portion in the frontward/rearward direction remote from the first outer cover 100 of the second outer cover 200, that is, the second pivot axis A2 is disposed at the rear end in the frontward/rearward direction of the second outer cover 200 when the second outer cover 200 is positioned at the second closing position. In the embodiment, the second pivot axis A2 is disposed rearward of a second discharge roller 62 to be described later.

The rear end surface of the first outer cover 100 faces the front end surface of the second outer cover 200 in a state where the first outer cover 100 is positioned at the first closing position and the second outer cover 200 is positioned at the second closing position.

In this way, since the first outer cover 100 and the second outer cover 200 are formed as a hinged double door or clamshell door, a hand holding position for opening the first outer cover 100 and a hand holding position for opening the second outer cover 200 can be provided at one concentrated position. Hence the operability and the designability can be improved. In the embodiment, as illustrated in FIG. 1, a hand holding portion 211 is formed at the end near the first outer cover 100 in the second outer cover 200. The hand holding portion 211 is recessed to be retracted from the first outer cover 100. Accordingly, the second outer cover 200 can be opened by holding the hand holding portion 211. Also, when the rear edge of the first outer cover 100 is held by a hand while the hand is inserted into the hand holding portion 211, the first outer cover 100 can be opened.

Figure 3:
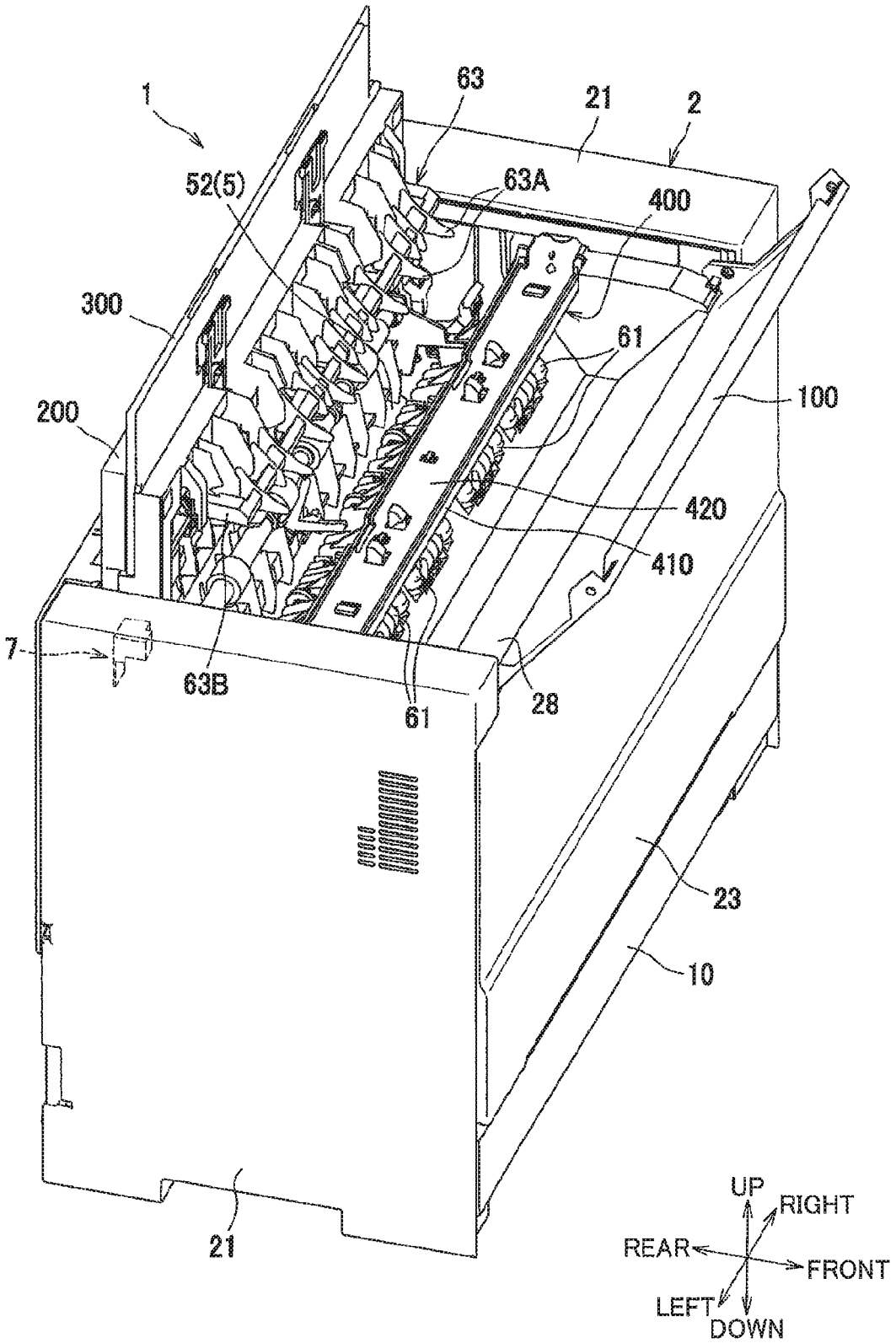
FIG. 3 is a perspective view of the laser printer in which the first outer cover, the second outer cover, and an inner cover are open.

As illustrated in FIG. 2, the inner cover 300 is a substantially rectangular member elongated in the leftward/rightward direction. The inner cover 300 is pivotally movable about a third pivot axis A3 (see FIG. 4) between a third closing position and a third opening position. The third pivot axis A3 extends in the leftward/rightward direction. The third closing position is a position at which the inner cover 300 covers the upper portion of the housing 2 as illustrated in FIG. 2. The third opening position is a position at which the inner cover is pivotally moved upward from the third closing position so that the upper portion of the housing 2 is exposed as illustrated in FIG. 3.

As illustrated in FIG. 4, the third pivot axis A3 of the inner cover 300 is disposed at the rear end of the inner cover 300. Accordingly, the front end portion of the inner cover 300 is movable up and down, and the inner cover 300 is opened in the same direction as the second outer cover 200. The inner cover 300 is disposed between the second outer cover 200 and the housing 2. When the second outer cover 200 is positioned at the second closing position and the inner cover 300 is positioned at the third closing position, the second outer cover 200 is stacked on the inner cover 300 in the upward/downward direction.

The laser printer 1 includes a sheet feeding unit 3, an image forming unit 4, a fixing unit 5, and a sheet discharging unit 6 those being disposed inside the housing 2.

The sheet feeding unit 3 is adapted to convey the sheet S inserted from the first sheet supply opening 24 and the sheet S inserted from the second sheet supply opening 25 toward the image forming unit 4. The sheet feeding unit 3 is provided with a placement portion 31, side guides 500, a sheet feeding mechanism 32, a sheet feeding path 33, and a registration roller 34.

The placement portion 31 is a wall extending forward and downward from a portion below the first sheet supply opening 24. The sheet S inserted from the first sheet supply opening 24 is placed on the placement portion 31.

The side guide 500 is a member that regulates the position of the sheet S inserted into the first sheet supply opening 24 in the widthwise direction of the sheet S, that is, the leftward/rightward direction. The side guide 500 is disposed inside the first sheet supply opening 24.

Figure 5:
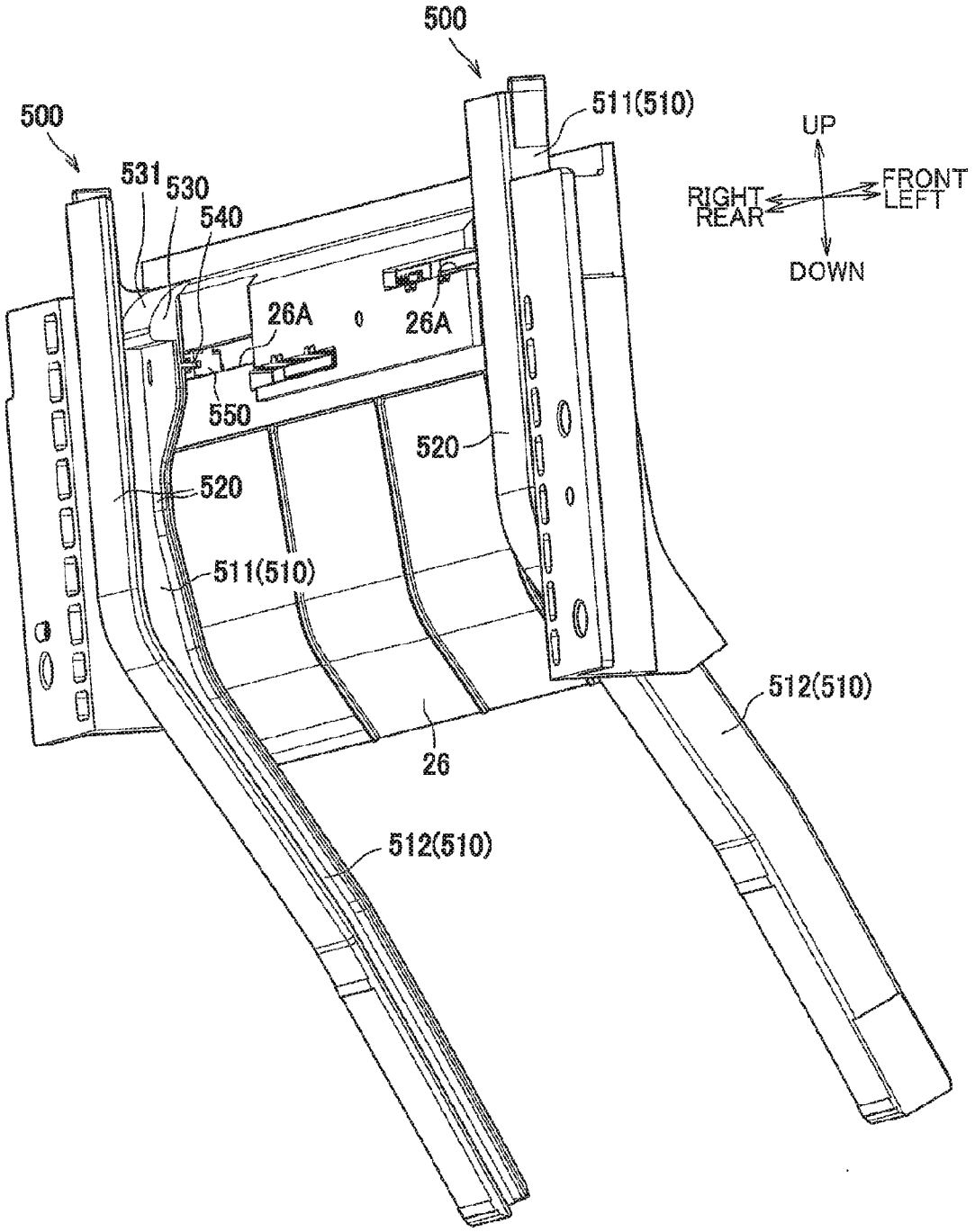
FIG. 5 is a perspective view of a pair of side guides and a support wall of the laser printer when viewed from a rear of the printer.

As illustrated in FIG. 5, the side guides 500 are provided as a pair of left and right side guides. Each of the side guides 500 is movably supported in the leftward/rightward direction by a support wall 26. Here, the housing 2 includes the support wall 26. As illustrated in FIG. 4, the support wall 26 is disposed frontward of the first sheet supply opening 24 in the frontward/rearward direction. The support wall 26 includes a first portion extending downward from a portion below the second pivot axis A2 of the second outer cover 200 and a second portion extending frontward and diagonally below along the placement portion 31 from the lower end portion of the first portion.

As illustrated in FIG. 5, each of the side guides 500 is disposed at the rear portion of the support wall 26. Each side guide 500 is formed in a substantial U-shape opened inward in the leftward/rightward direction, and includes a regulation portion 510, a pair of guide walls 520 and a guide protrusion 530. The regulation portion 510 is perpendicular to the leftward/rightward direction. The pair of guide walls 520 extends from the regulation portion 510.

The regulation portion 510 is an elongated wall, and regulates the position of the sheet S in the leftward/rightward direction while contacting the end of the sheet S in the leftward/rightward direction. The regulation portion 510 includes a first portion 511 and a second portion 512. The first portion 511 extends in the upward/downward direction. The second portion 512 extends forward and downward from the lower end of the first portion 511.

The pair of guide walls 520, that is, the rear guide wall 520 and front guide wall 520 protrude inward in the leftward/rightward direction from both ends of the regulation portion 510 in the short dimension direction, respectively. The rear guide wall 520 is provided from the upper end portion to the lower end portion in the regulation portion 510. The front guide wall 520 is provided from a position below the upper end portion of the regulation portion 510 to the lower end portion of the regulation portion 510. That is, the regulation portion 510 protrudes above the front guide wall 520, and the front end surface of the regulation portion 510 faces the rear end portion of the second outer cover 200 (see FIG. 4).

The guide protrusion 530 protrudes rearward from the upper end portion of the front guide wall 520. The guide protrusion 530 extends backward as it goes downward and has a guide surface 531 which guides the sheet S inserted into the first sheet supply opening 24. The guide protrusion 530 may be provided at both sides or only one side of the pair of side guides 500.

The side guide 500 includes a guided portion 540 which protrudes forward from the front guide wall 520 at the upper end portion (which is illustrated only at the right side in FIG. 5). The support wall 26 is formed with a guide hole 26A. The guide hole 26A extends in the leftward/rightward direction at a position corresponding to the guided portion 540 in the upward/downward direction. Then, the guided portion 540 passes through the guide hole 26A and is fixed to a rack gear 550 provided at the front portion of the support wall 26. Specifically, the guided portion 540 is fixed to the outer end portion of the rack gear 550 in the leftward/rightward direction. In addition, the outer end portion of the rack gear 550 in the leftward/rightward direction is engaged with the guided portion 540. The support wall is an example of a wall.

Figure 6:
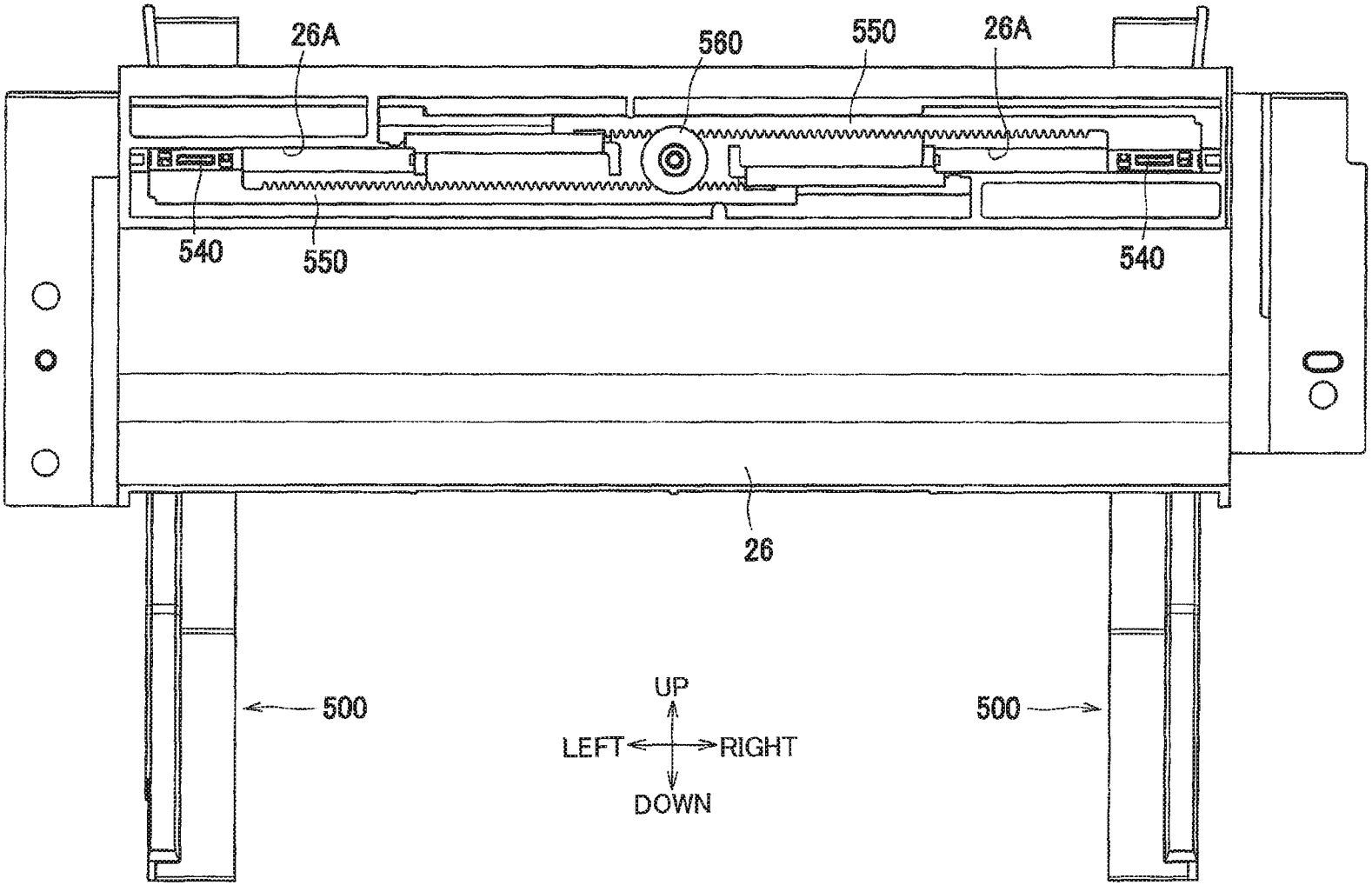
FIG. 6 is a view of the pair of side guides and the support wall of the laser printer when viewed from a front of the printer.

As illustrated in FIG. 6, the pair of rack gears 550 and a pinion gear 560 are provided at the front portion of the support wall 26. Each rack gear 550 faces with each other and extends in the leftward/rightward direction. Gear teeth are formed at each facing side of the rack gear 550. The pinion gear 560 is rotatably supported by the support wall 26 between the pair of rack gears 550. The pinion gear 560 is engaged with the gear teeth of the rack gears 550.

With such a configuration, when one side guide 500 of the pair of side guides 500 is moved in the leftward/rightward direction, the other side guide 500 moves in a synchronization manner in the leftward/rightward direction. Then, since the pair of side guides 500 sandwiches the sheet S inserted into the first sheet supply opening 24 in the leftward/rightward direction, the regulation portion 510 contacts the ends of the sheet S in the leftward/rightward direction, resulting in regulating the position of the sheet S in the leftward/rightward direction. Further, the pair of side guides 500 is adapted to guide the sheet S toward the sheet feeding mechanism 32 by the pair of guide walls 520.

As illustrated in FIG. 4, the sheet feeding mechanism 32 is a mechanism that feeds the sheet S on the placement portion 31 toward the image forming unit 4. The sheet feeding mechanism 32 includes a pickup roller 32A, a separation roller 32B, a separation pad 32C, and a conveying roller 32D.

The pickup roller 32A is provided so as to contact the sheet S on the placement portion 31. The sheet S is fed forward and diagonally below by rotation of the pickup roller 32A. The separation roller 32B is disposed downstream of the pickup roller 32A in the conveying direction of the sheet S. The separation roller 32B is provided so as to face the separation pad 32C. Here, the sheet S is conveyed forward one by one while the sheet S fed from the pickup roller 32A is nipped between the separation roller 32B and the separation pad 32C.

The conveying roller 32D is disposed downstream of the separation roller 32B in the conveying direction of the sheet S. The conveying roller 32D is adapted to convey the sheet S conveyed from the separation roller 32B forward.

The sheet feeding path 33 is a path used to convey the sheet S supplied from the first sheet supply opening 24 toward the image forming unit 4. The sheet feeding path 33 includes a U-turn guide 33A. The U-turn guide 33A contacts the sheet S so that the sheet S is conveyed forward and downward and is then conveyed toward the image forming unit 4 (a gap between a photosensitive drum 41 and a transfer roller 44) disposed upward and rearward of the U-turn guide 33A.

The second sheet supply opening 25 communicates with the U-turn guide 33A at the downstream side of the conveying roller 32D in the conveying direction of the sheet S and is merged with the sheet feeding path 33. Accordingly, the sheet S inserted into the second sheet supply opening 25 is supplied to the downstream side in the conveying direction of the sheet S in relation to the conveying roller 32D.

The registration roller 34 is adapted to feed the sheet S in the sheet feeding path 33 to the image forming unit 4 at a predetermined timing.

The image forming unit 4 is provided above the sheet feeding mechanism 32 and is disposed at the center portion inside the housing 2 in the upward/downward direction. The image forming unit 4 includes the photosensitive drum 41, a charging unit 42, an exposure member 43, the transfer roller 44, a developing roller 45, and a toner accommodating portion 46.

The transfer roller 44 is disposed rearward and downward of the photosensitive drum 41. The transfer roller 44 is provided so as to nip the sheet S between the photosensitive drum 41 and the transfer roller 44. Accordingly, in the image forming unit 4, the sheet S fed from the registration roller 34 is conveyed rearward and upward.

In the image forming unit 4, the circumferential surface of the rotating photosensitive drum 41 is uniformly charged by the charging unit 42 and is exposed by the exposure member 43. Accordingly, the potential of the exposed portion is decreased and an electrostatic latent image based on image data is formed on the circumferential surface of the photosensitive drum 41.

Next, the toner stored in the toner accommodating portion 46 is supplied to the electrostatic latent image of the photosensitive drum 41 by the developing roller 45 and hence a toner image is formed on the circumferential surface of the photosensitive drum 41. Subsequently, the toner image carried on the circumferential surface of the photosensitive drum 41 is transferred onto the sheet S when the sheet S is nipped between the photosensitive drum 41 and the transfer roller 44.

The fixing unit 5 is provided upward of the image forming unit 4 in the upward/downward direction and is provided at an upper portion of the interior of the housing 2. The fixing unit 5 includes a heating roller 51 and a pressing roller 52.

The heating roller 51 is a member that heats the sheet S. The heating roller 51 includes a heat source 53 such as a halogen lamp inside. The pressing roller 52 is a member that conveys the sheet S while nipping the sheet between the heating roller 51 and the pressing roller 52. The pressing roller 52 is disposed rearward of the heating roller 51.

Then, in the fixing unit 5 with such a configuration, the toner image transferred onto the sheet S is thermally fixed thereto while the sheet S passes through between the heating roller 51 and the pressing roller 52. In addition, the sheet S onto which the toner image is thermally fixed by the fixing unit 5 is conveyed toward the sheet discharging unit 6 disposed downstream of the fixing unit 5 in the conveying direction. The toner image is an example of a developing agent image.

The sheet discharging unit 6 is provided above the fixing unit 5 and includes a first discharge roller 61, the second discharge roller 62, and a switching member 63.

The first discharge roller 61 is provided at the upper portion of the housing 2. More specifically, the first discharge roller 61 is disposed frontward and downward of the fixing unit 5 and is adapted to discharge the sheet S toward the outside of the housing 2. Specifically, the first discharge roller 61 is disposed near a first discharge opening 27. the first discharge is formed at the upper portion of the housing 2 so as to be opened forward.

The first discharge roller 61 includes an upper roller 61A and a lower roller 61B. The lower roller 61B is disposed frontward and downward of the upper roller 61A and is adapted to nip the sheet S between the upper roller 61A and the lower roller 61B. The upper roller 61A and the lower roller 61B are provided so as to be rotatable about the rotation shafts extending in the leftward/rightward direction and are adapted to discharge the sheet S forward through the first discharge opening 27. In addition, the housing 2 includes a sheet discharging tray 28. The sheet discharging tray 28 is disposed frontward of the first discharge opening 27 so that the sheet S discharged from the first discharge opening 27 is placed on the sheet discharging tray 28.

The upper roller 61A is rotatably supported by a support frame 400. The support frame 400 is disposed above the first discharge roller 61 and constitutes the housing 2. As illustrated in FIG. 3, the support frame 400 is provided so as to be suspended between the pair of side walls 21. The support frame 400 includes, as illustrated in FIG. 4, a first support frame 410 and a second support frame 420. The first support frame 410 is formed of resin and supports a bearing 64 of the upper roller 61A. The second support frame 420 is disposed above the first support frame 410. The second support frame 420 is formed of metal and reinforces the first support frame 410. With such a configuration, the distortion of the first support frame 410 generated when the upper roller 61A receives a force from the lower roller 61B can be suppressed.

The second discharge roller 62 is disposed at the upper portion of the housing 2. More specifically, the second discharge roller 62 is disposed upward of the fixing unit 5 and is adapted to discharge the sheet S toward the outside of the housing 2. Specifically, the second discharge roller 62 is disposed inside the housing 2 in relation to a second discharge opening 29. The second discharge opening 29 is formed at the upper portion of the housing 2 so as to be opened upward.

The second discharge roller 62 includes a first roller 62A and a second roller 62B. The second roller 62B is disposed frontward and upward of the first roller 62A and is adapted to nip the sheet S between the first roller 62A and the second roller 62B. The first roller 62A and the second roller 62B are disposed so that the tangential line L passing through the contact point between the first roller 62A and the second roller 62B is inclined backward with respect to the upward/downward direction. The tangential line L is a common tangential line in contact with both the first roller 62A and the second roller 62B. The first roller 62A and the second roller 62B are rotatable about the rotation shafts extending in the leftward/rightward direction.

The second discharge roller 62 and a part of the first discharge roller 61 are overlapped when viewed in a perpendicular direction perpendicular to both the upward/downward direction (vertical direction) and the axial direction of the first discharge roller 61, that is, the frontward/rearward direction.

Further, in the embodiment, the second roller 62B is rotatably supported by the inner cover 300. Accordingly, when the inner cover 300 is opened, the sheet S jammed between the first roller 62A and the second roller 62B is easily extracted.

The switching member 63 is provided so as to pivotally move with respect to the housing 2 between a first position (see the solid line) and a second position (see the two-dotted chain line). The switching member 63 is adapted to switch a conveyance destination of the sheet S. In the first position, the switching member 63 guides the sheet S having passed through the fixing unit 5 toward the first discharge roller 61. In the second position, the switching member 63 guides the sheet S having passed through the fixing unit 5 toward the second discharge roller 62. The switching member 63 is attached to the inner cover 300. In addition, the detailed configuration of the switching member 63 will be described later. The switching member 63 is an example of a changeover member.

The first outer cover 100 is disposed above the first discharge roller 61 and the sheet discharging tray 28. The first outer cover 100 is adapted to cover the sheet discharging tray 28 when being positioned at the first closing position (see the two-dotted chain line). Then, the first outer cover 100 is adapted to expose the first discharge roller 61 and the sheet discharging tray 28 to the outside of housing 2 when being positioned at the first opening position (see the solid line). Further, in the first opening position, the first outer cover 100 is inclined forward relative to the upward/downward direction and continuously extends forward from the front end portion of the sheet discharging tray 28. Accordingly, when the first outer cover 100 is positioned at the first opening position, the sheet S discharged from the first discharge roller 61 is supported by the sheet discharging tray 28 and the first outer cover 100.

The second outer cover 200 is adapted to cover the upper portion of the second discharge roller 62 and the upper end of the second discharge opening 29 when being positioned at the second closing position (see the solid line). Then, the second outer cover 200 is adapted to expose the second discharge roller 62 and the second discharge opening 29 when being positioned at the second opening position (see the two-dotted chain line). Further, in the second opening position, the second outer cover 200 is inclined forward relative to the upward/downward direction. That is, the tangential line L passing through the contact point between the first roller 62A and the second roller 62B intersects the second outer cover 200 when the second outer cover 200 is positioned at the second opening position.

With such a configuration, the second outer cover 200 is adapted to guide a travel of the sheet S discharged from the second discharge roller 62 forward when being located at the second opening position.

In the second opening position, the entire second outer cover 200 is positioned frontward of a rear side surface 22A of the housing 2. In other words, the second outer cover 200 in its entirety is deviated forward relative to a rear side surface 22A. Thus, for example, even when a wall exists behind the laser printer 1 and the second outer cover 200 is opened, the second outer cover 200 does not contact the building wall. Therefore the laser printer 1 can be installed in a state where the rear wall 22 is in abutment with the wall.

In the third closing position, the inner cover 300 is disposed above the fixing unit 5 and the support frame 400, and covers the fixing unit 5 and the support frame 400. In a state where the inner cover 300 is located at the third closing position, a front end 301 of the inner cover 300 is provided at a position the same as a front end 401 of the support frame 400 when viewed from the upward/downward direction, that is the front end 301 of the inner cover 300 is aligned with the front end 401 of the support frame 400 in the upward/downward direction. The front end 301 is an example of one end of the third cover. The front end 401 is an example of one end of the support frame.

Then, the inner cover 300 is adapted to expose the fixing unit 5 and the support frame 400 when being located at the third opening position as illustrated in FIG. 3.

Returning to FIG. 4, in a state where the first outer cover 100 is positioned at the first closing position and the second outer cover 200 is positioned at the second closing position, the length of the first outer cover 100 in the frontward/rearward direction is greater than the length of the second outer cover 200 in the frontward/rearward direction. In this way, since the first outer cover 100 supporting the discharged sheet S is formed in a large size, enhanced stackability of the sheet S can be obtained.

Further, a boundary B between the first outer cover 100 at the first closing position and the second outer cover 200 at the second closing position overlaps the inner cover 300 when viewed from the upward/downward direction. Accordingly, since foreign matter entering from the boundary B between the first outer cover 100 and the second outer cover 200 can be received by the inner cover 300, the entry of the foreign matter into the housing 2 can be suppressed.

Figure 7:
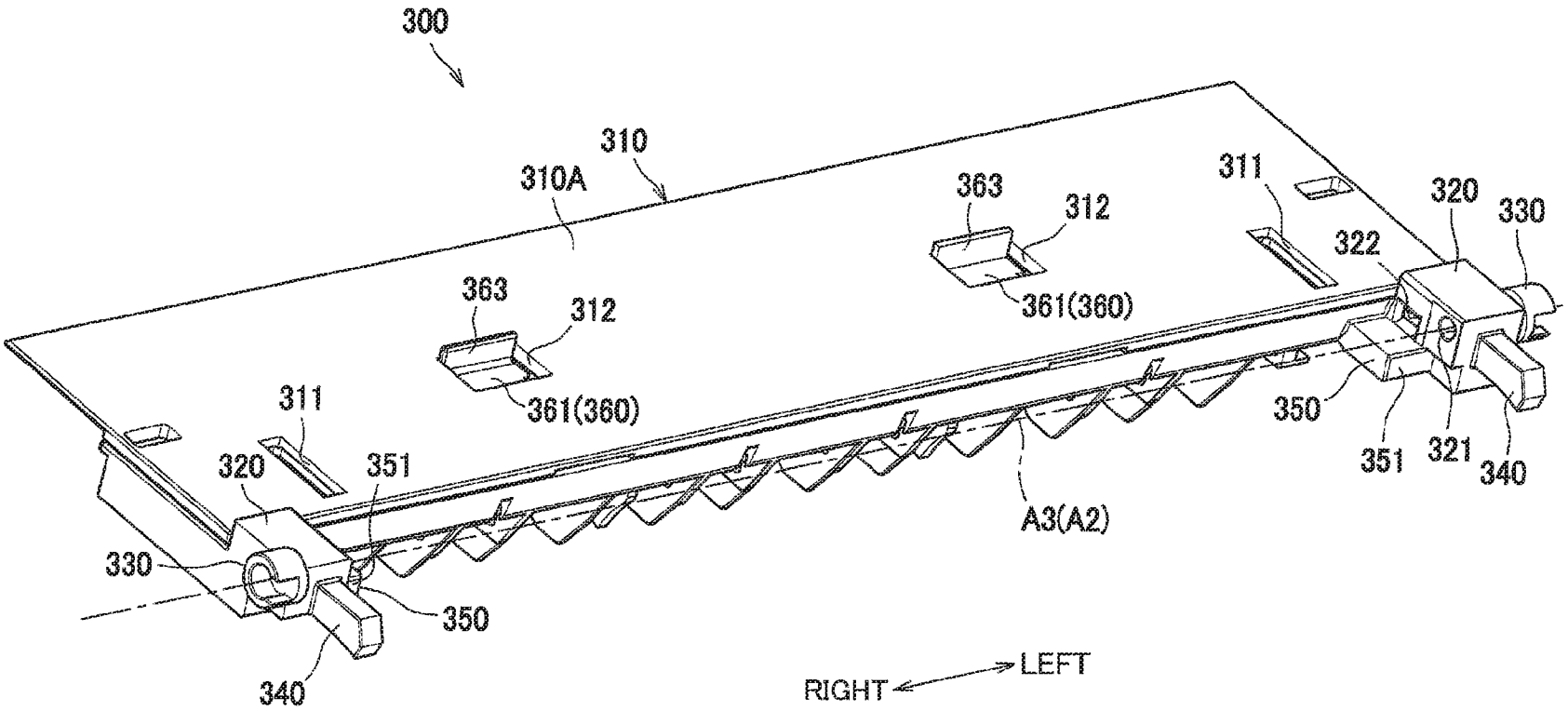
FIG. 7 is a perspective view of the inner cover when view the inner cover from its adverse side.

Next, the configurations of the second outer cover 200 and the inner cover 300 will be described in detail. As illustrated in FIG. 7, the inner cover 300 includes a main body 310, a second leg portion 320, a second shaft portion 330, a second engagement portion 340, and a contact protrusion 350. The main body 310 has a plate shape extending in the leftward/rightward direction. The second leg portion 320 is provided at each of left and right end portions of the main body 310. The second shaft portion 330 protrudes outward from each second leg portion 320 in the leftward/rightward direction. The second engagement portion 340 protrudes from each second leg portion 320. The contact protrusion 350 is disposed inward of each of the second leg portions 320 in the leftward/rightward direction.

The main body 310 includes a first surface 310A and a second surface 310B. In a state where the inner cover 300 is positioned at the third closing position, the first surface 310A faces the outside of the housing 2, that is, faces upward, and the second surface 310B (see FIG. 8) faces the inside of the housing 2, that is, faces downward. Further, the main body 310 is formed with insertion holes 311 and openings 312.

The insertion hole 311 penetrates the main body 310 in the upward/downward direction, and is formed at both end portions of the main body 310 in the leftward/rightward direction. The opening portion 312 penetrates the main body 310 in the upward/downward direction, and is formed at two positions inside two insertion holes 311 in the leftward/rightward direction. The two openings 312 are arranged side by side in the leftward/rightward direction.

The second leg portion 320 protrudes outward in the short dimension direction of the main body 310 from one end portion of the main body 310 in the short dimension direction, specifically, from the rear end portion of the inner cover 300 when the inner cover 300 is located at the third closing position. The inner surface of the second leg portion 320 in the leftward/rightward direction is formed with a support hole 321 and an engaged groove 322.

The support hole 321 is formed in a circular shape and is recessed outward in the leftward/rightward direction from the inner surface of the second leg portion 320. The engaged groove 322 is formed at a position nearer to the main body 310 than the support hole 321. The engaged groove 322 is recessed outward in the leftward/rightward direction from the inner surface of the second leg portion 320. The engaged groove 322 is as an example of an engaged portion.

The second shaft portion 330 has a substantially hollow cylindrical shape, and a part of the second portion 330 in the circumferential direction is opened. An inner circumferential surface of the second shaft portion 330 provides a center axis coincident with a center axis of the support hole 321. The second shaft portion 330 is axially supported by the housing 2. Accordingly, the inner cover 300 is pivotally movable relative to the housing 2 about the third pivot axis A3 passing through the center of the second shaft portion 330.

The second engagement portion 340 protrudes in a direction away from the main body 310 from the second leg portion 320 in the short dimension direction of the main body 310. That is, the second engagement portion 340 extends from the second leg portion 320 in a direction orthogonal to the direction in which the third pivot axis A3 extends.

Figure 15A:
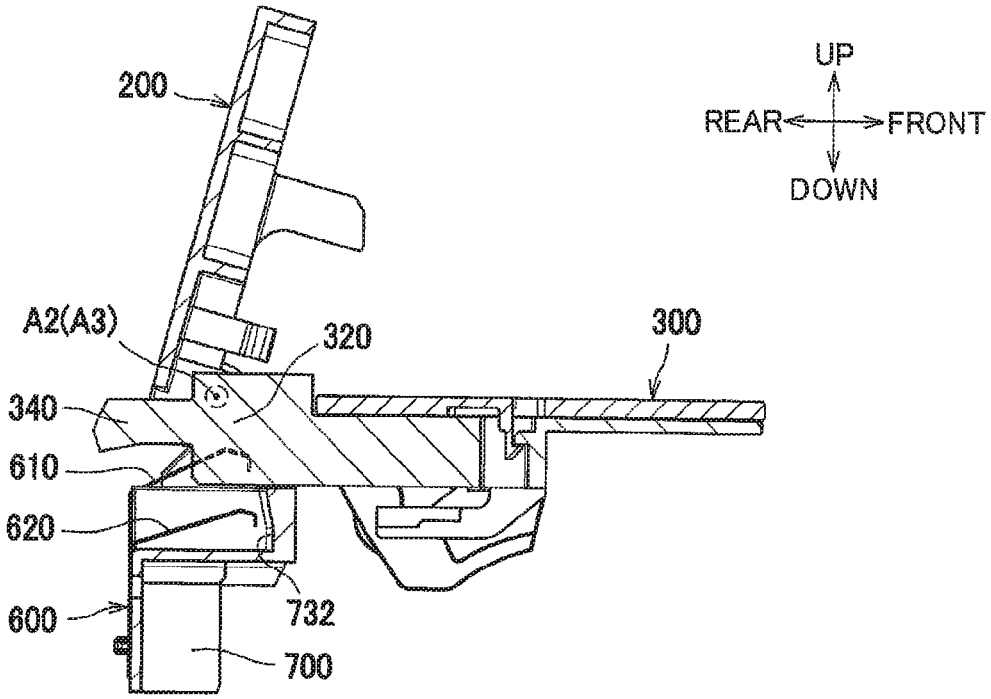
FIG. 15A is a cross-sectional view of the inner cover, the second outer cover, and the cover holding member taken along a plane passing through a second engaging portion and showing a state where the inner cover is at a third closing position.
Figure 15B:
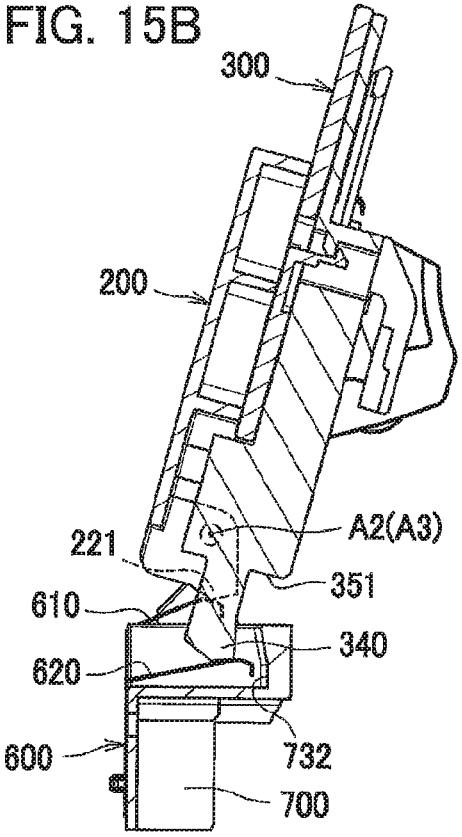
FIG. 15B is a cross-sectional view of the inner cover, the second outer cover, and the cover holding member taken along the plane passing through the second engaging portion and showing a state where the second outer cover which is at the second open position is stacked on the inner cover.
Figure 15C:
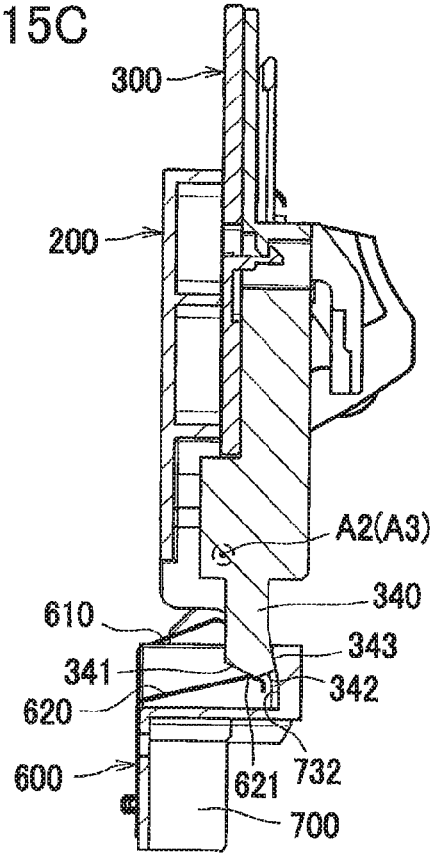
FIG. 15C is a cross-sectional view of the inner cover, the second outer cover, and the cover holding member taken along the plane passing through the second engaging portion and showing a state where the inner cover is at a third opening position.

As illustrated in FIG. 15C, the distal end portion of the second engagement portion 340 has a first surface 341, a second surface 342, and a third surface 343. In a state where the inner cover 300 is positioned at the third opening position, the first surface 341 extends frontward and downward, the second surface 342 extends forward and upward from the first surface 341, and the third surface 343 extends upward from the second surface 342.

Figure 14A:
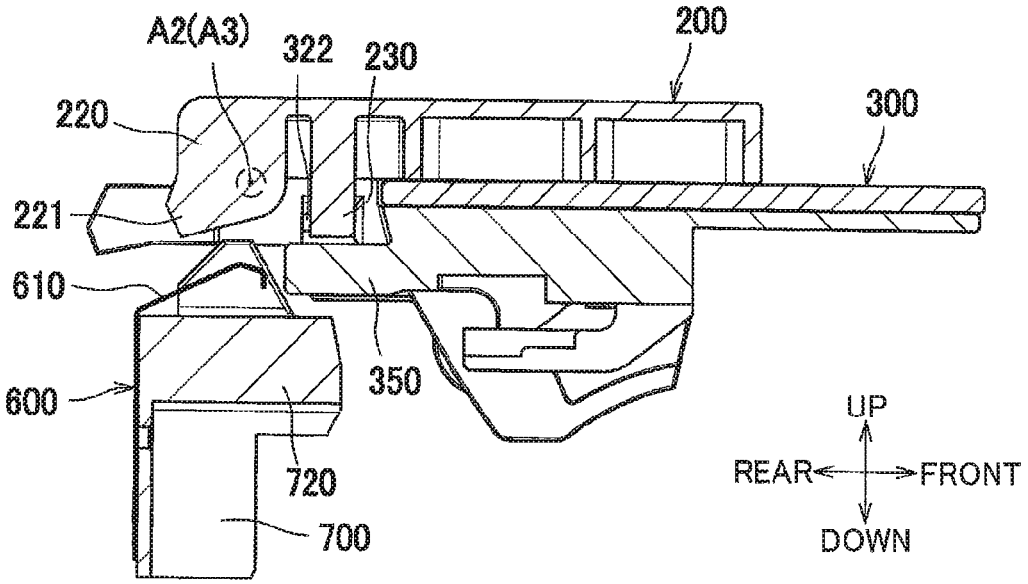
FIG. 14A is a cross-sectional view of the inner cover, the second outer cover, and the cover holding member taken along a plane passing through a first engaging portion and showing a state where the second outer cover is at a second closing position.

As illustrated in FIG. 7, the contact protrusion 350 protrudes backward from the main body 310 in a state where the inner cover 300 is positioned at the third closing position (see FIG. 14A). Then, a abutment wall 351 forms the rear end portion of the contact protrusion 350 when the inner cover 300 is located at the third closing position. The abutment wall 351 is closer to the main body 310 than the support hole 321 in the short dimension direction of the main body 310.

Figure 8:
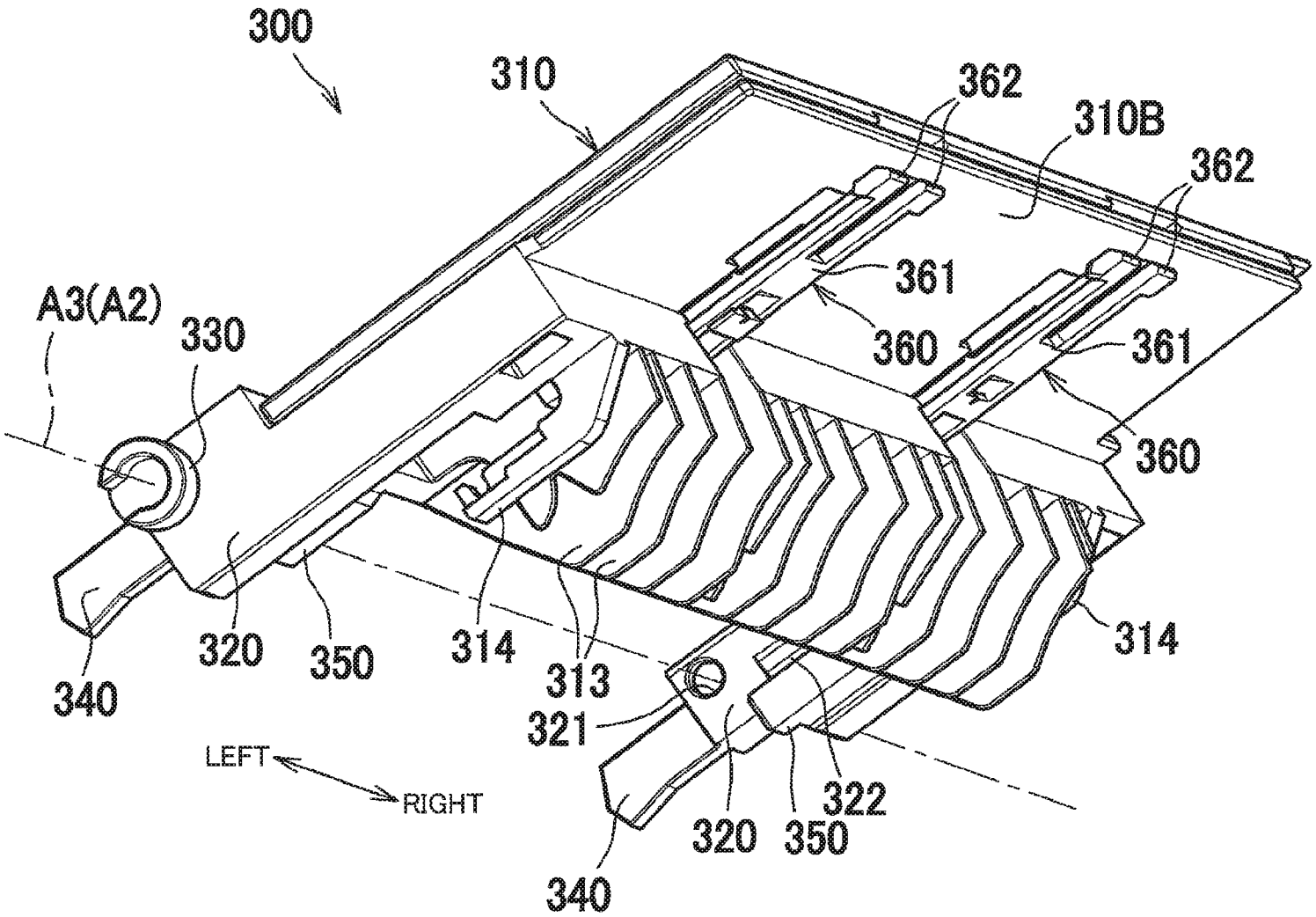
FIG. 8 is a perspective view of the inner cover when view the inner cover from its reverse side.

As illustrated in FIG. 8, the second surface 310B of the inner cover 300 is provided with a plurality of guide ribs 313, a switching member holding portion 314, and a pair of locking members 360.

In a state where the inner cover 300 is positioned at the third closing position, the pair of locking members 360 locks the inner cover 300 with respect to the support frame 400, and prevents the inner cover 300 from being opened.

The pair of locking members 360 are arrayed and away from each other in leftward/rightward direction. The pair of locking members 360 is supported by the main body 310, and is movable in the short dimension direction of the main body 310. Each locking member 360 includes a slide portion 361, a lock claw 362. The slide portion 361 extends in the short dimension direction of the main body 310. The lock claw 362 protrudes from the slide portion 361 toward both directions in the leftward/rightward direction. As illustrated in FIG. 7, each locking member 360 includes an operation knob 363. The operation knob 363 extends from the slide portion 361, and protrudes from the first surface 310A through the opening portion 312 of the main body 310.

Figure 9:
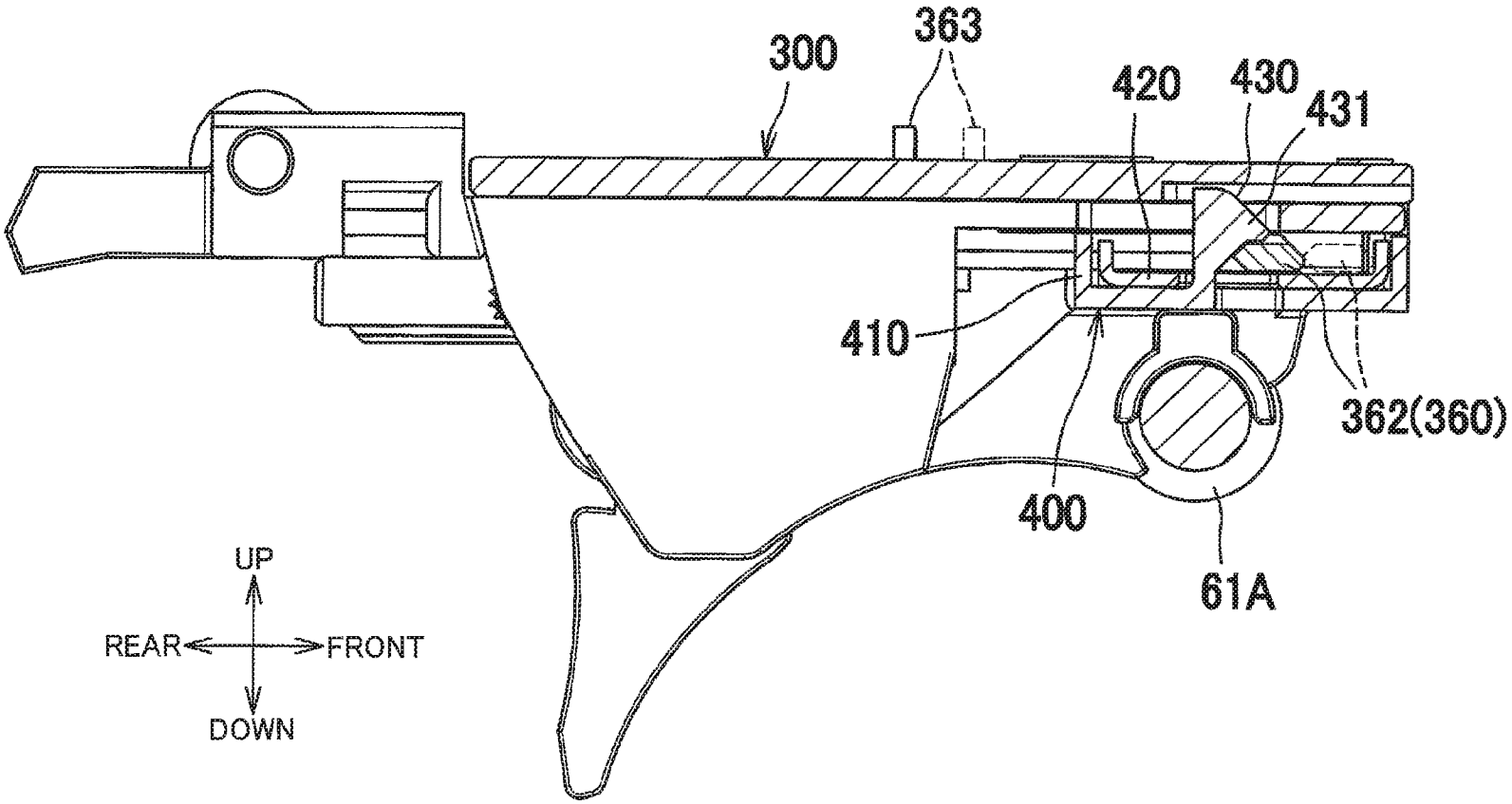
FIG. 9 is a cross-sectional view of the inner cover and the support frame in the laser printer.

Here, the support frame 400 includes a stopper 430 which is provided at a position corresponding to the lock claw 362 in the leftward/rightward direction as illustrated in FIG. 9. The stopper 430 extends upward from the upper surface of the support frame 400. The stopper 430 includes an engagement claw 431. The engagement claw 431 protrudes forward and forms the distal end portion of the stopper 430.

The locking member 360 is urged by an urging member (not illustrated) in a direction in which the lock claw 362 engages with the engagement claw 431, that is, a backward direction in a state where the inner cover 300 is located at the third closing position. Then, when the operation knob 363 of the locking member 360 is moved forward, the lock claw 362 is retracted forward from the engagement claw 431 (see the dashed line) so that the locking state of the inner cover 300 is released.

As illustrated in FIG. 8, the plurality of guide ribs 313 is disposed in parallel in the leftward/rightward direction. The plurality of guide ribs 313 is adapted to guide the sheet S conveyed toward the first discharge roller 61 in a state where the inner cover 300 is positioned at the third closing position.

Figure 12A:
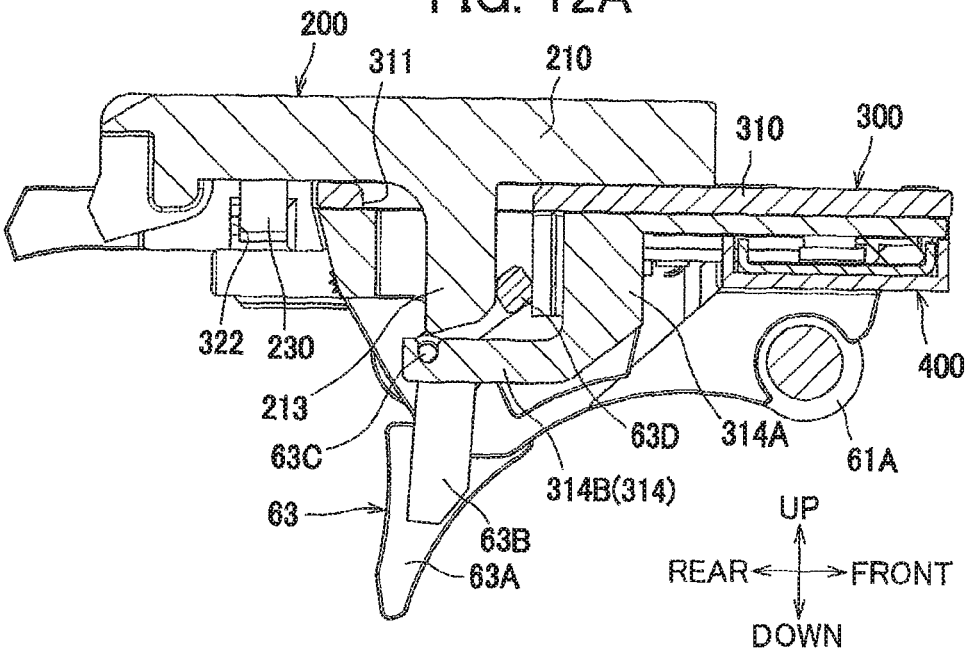
FIG. 12A is a cross-sectional view of the support frame, the inner cover, and the second outer cover taken along a plane passing through an operating portion and showing a state where the second outer cover is at a second closing position.
Figure 12B:
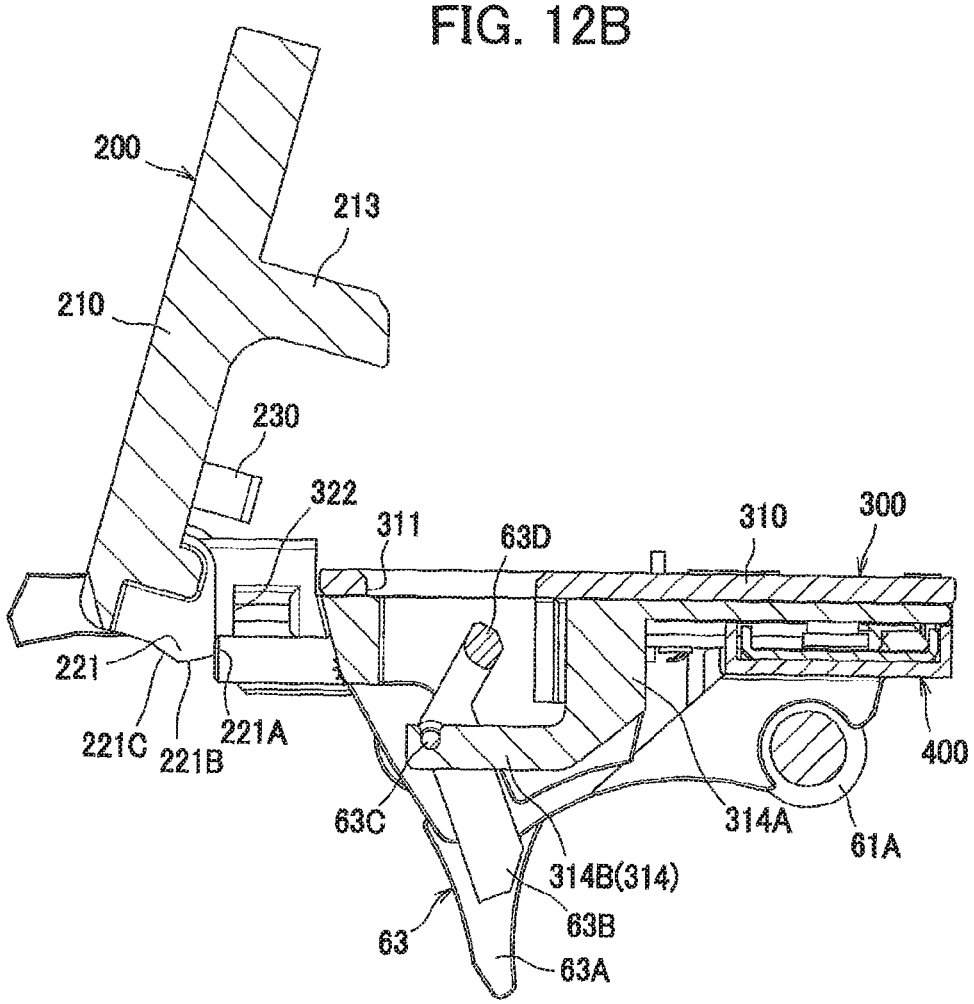
FIG. 12B is a cross-sectional view of the support frame, the inner cover, and the second outer cover taken along the plane passing through the operating portion and showing a state where the second outer cover is at a second opening position.

The switching member holding portion 314 is disposed outward of the plurality of guide ribs 313 in the leftward/rightward direction. More specifically, as illustrated in FIG. 12B, the switching member holding portion 314 is disposed at a position the same as the insertion hole 311 in the leftward/rightward direction. The switching member holding portion 314 includes a base portion 314A and a holding portion 314B. The base portion 314A protrudes from the main body 310. The holding portion 314B extends along the main body 310 from the base portion 314A to a position facing the insertion hole 311.

The switching member 63 includes a plurality of guide plates 63A, a connection member 63B, a shaft 63C, and a target action portion 63D. The connection member 63B connects the plurality of guide plates 63A. The shaft 63C protrudes outward in the leftward/rightward direction from the connection member 63B and is axially supported by the holding portion 314B. The target action portion 63D extends from the shaft 63C toward the main body 310 of the inner cover 300 and protrudes outward in the leftward/rightward direction.

The plurality of guide plates 63A is adapted to guide the sheet S while contacting the sheet S. The plurality of guide plates 63A is disposed in parallel in the leftward/rightward direction as illustrated in FIG. 3. Then, as illustrated in FIG. 12B, the target action portion 63D is disposed at a position facing the insertion hole 311 of the inner cover 300. In addition, the switching member 63 is urged toward the second position by an urging member (not illustrated).

Figure 10:
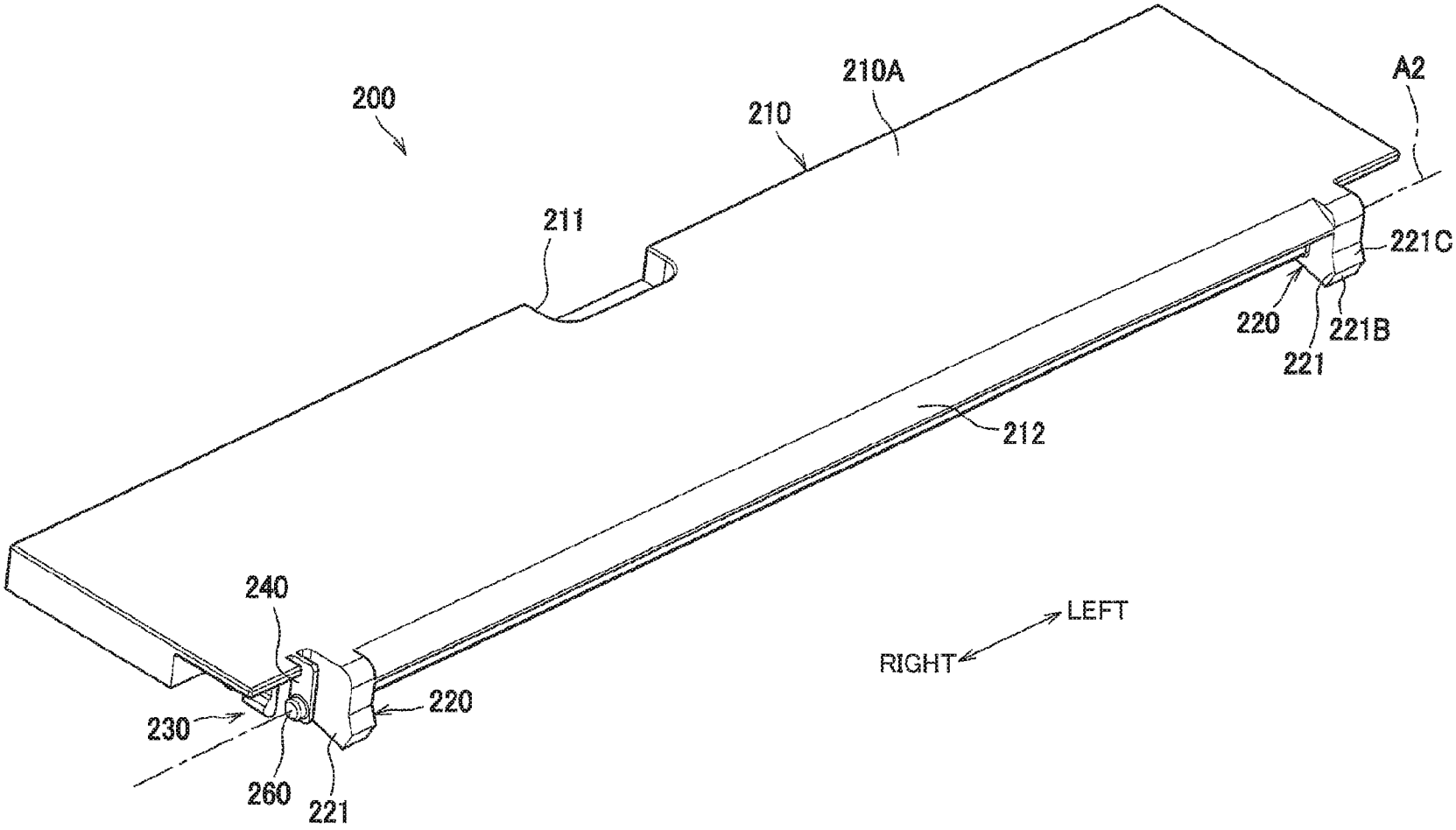
FIG. 10 is a perspective view of the second outer cover when view the second outer cover from its adverse side.

As illustrated in FIG. 10, the second outer cover 200 includes a plate-shaped cover body 210 elongated in the leftward/rightward direction, a first leg portion 220 provided at each of both left and right ends of the cover body 210, a hook 230, and an extension portion 240.

The cover body 210 has a front surface 210A and a rear surface 210B. When the second outer cover 200 is located at the second closing position, the front surface defines the upper surface of the apparatus, and the rear surface 210B faces the inside of the housing 2 (see FIG. 11). Further, the hand holding portion 211 is provided at one end portion of the cover body 210 in the short dimension direction thereof. Then, the cover body 210 includes an inclined surface 212 extending the leftward/rightward direction. The inclined surface is defined on the other end portion of the front surface 210A of the cover body 210 in the short dimension direction.

As illustrated in FIG. 4, in a state where the second outer cover 200 is located at the second closing position, the inclined surface 212 is provided at the rear end portion of the second outer cover 200 in the frontward/rearward direction and is inclined forward in proportion to upward orientation. Then, the rear end portion of the inclined surface 212 and the guide surface 531 of the side guide 500 are overlapped when viewed from the upward/downward direction while the second outer cover 200 is located at the second closing position. In addition, the length of the inclined surface 212 in the leftward/rightward direction is substantially equal to the length of the first sheet supply opening 24 in the leftward/rightward direction (See FIG. 1).

Since the inclined surface 212 is provided in this way, the sheet S is guided by the inclined surface 212 when the sheet S is inserted into the first sheet supply opening 24, and hence the sheet S is easily inserted into the first sheet supply opening 24. Then, since the sheet S guided by the inclined surface 212 is guided by the guide surface 531 disposed below the inclined surface 212, the sheet S can be more easily inserted into the first sheet supply opening 24.

Further, if the second outer cover 200 is not provided with the inclined surface 212, when the second outer cover 200 is opened in a state where the sheet S is inserted into the first sheet supply opening 24, there is a possibility that the corner of the rear end portion of the second outer cover 200 may contact the sheet S. In the embodiment, since the inclined surface 212 is provided at the rear end portion of the second outer cover 200, the above problem that the second outer cover 200 contacts the sheet S inserted into the first sheet supply opening 24 when the second outer cover 200 is opened can be prevented. Further, since the second outer cover 200 and the sheet S inserted into the first sheet supply opening 24 do not interfere with each other, the second outer cover 200 and the first sheet supply opening 24 can be disposed in a close position, and hence the size of the apparatus in the frontward/rearward direction can be reduced.

Figure 11:
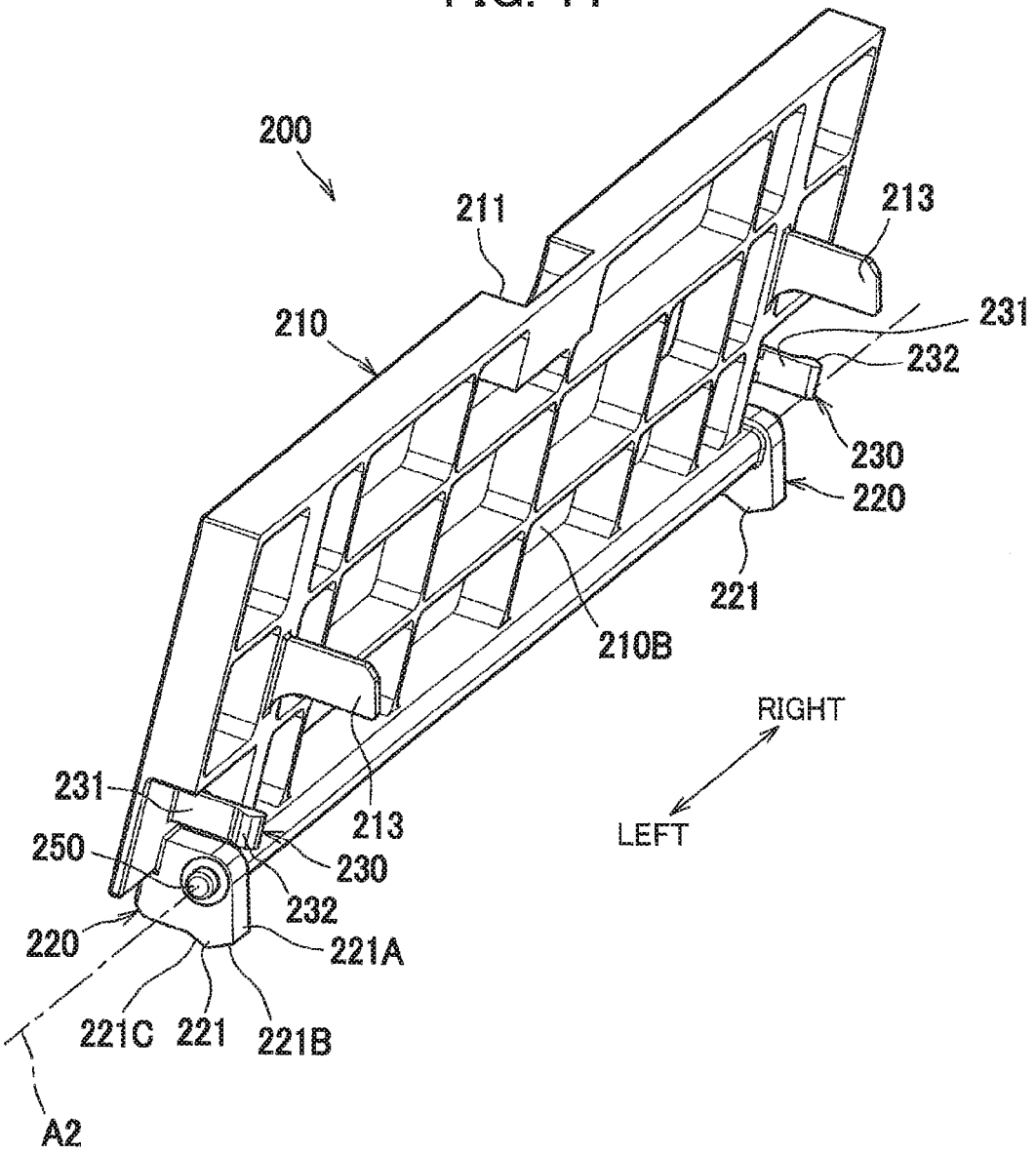
FIG. 11 is a perspective view of the second outer cover when view the second outer cover from its reverse side.

As illustrated in FIG. 10, the first leg portion 220 is provided at both sides of the inclined surface 212 in the leftward/rightward direction. As illustrated in FIG. 11, the first leg portion 220 protrudes from the rear surface 210B of the cover body 210. The outer surface of the left first leg portion 220 in the leftward/rightward direction is provided with a first shaft portion 250 which protrudes outward in the leftward/rightward direction.

Meanwhile, as illustrated in FIG. 10, the right first leg portion 220 is not provided with the first shaft portion 250. The extension portion 240 is provided with a first shaft portion 260. The extension portion 240 extends so as to protrude from the rear surface 210B at the outside of the right first leg portion 220 in the leftward/rightward direction. The first shaft portion 260 protrudes from the outer surface of the extension portion 240 in the leftward/rightward direction. The first shaft portion 260 is formed such that the center of the first shaft matches the center of the first shaft portion 250 provided in the left first leg portion 220 when viewed from the leftward/rightward direction. In other words, the center of the first shaft portion 260 and the center of the first shaft portion 250 are coincident with each other and extending in the leftward/rightward direction.

Then, the first shaft portions 250 and 260 engage with the support holes 321 (see FIGS. 7 and 8) of the inner cover 300 and are pivotally supported by the inner cover 300. The first shaft portions 250 and 260 are pivotally movable about the second pivot axis A2 passing through the centers of the first shaft portions 250 and 260. That is, the second outer cover 200 is axially supported by the inner cover 300. Further, as illustrated in FIG. 14A, the second pivot axis A2 of the second outer cover 200 overlaps the third pivot axis A3 of the inner cover 300 and the second outer cover 200 and the inner cover 300 are pivotally movable about the same axis.

As illustrated in FIG. 10, each first leg portion 220 includes a first engagement portion 221. The first engage portion protrudes in a direction remote from the cover body 210 in the short dimension direction thereof. The first engagement portion 221 extends in a direction perpendicular to the extension direction of the second pivot axis A2 from the second pivot axis A2 that is the rotation center of the second outer cover 200.

Figure 14B:
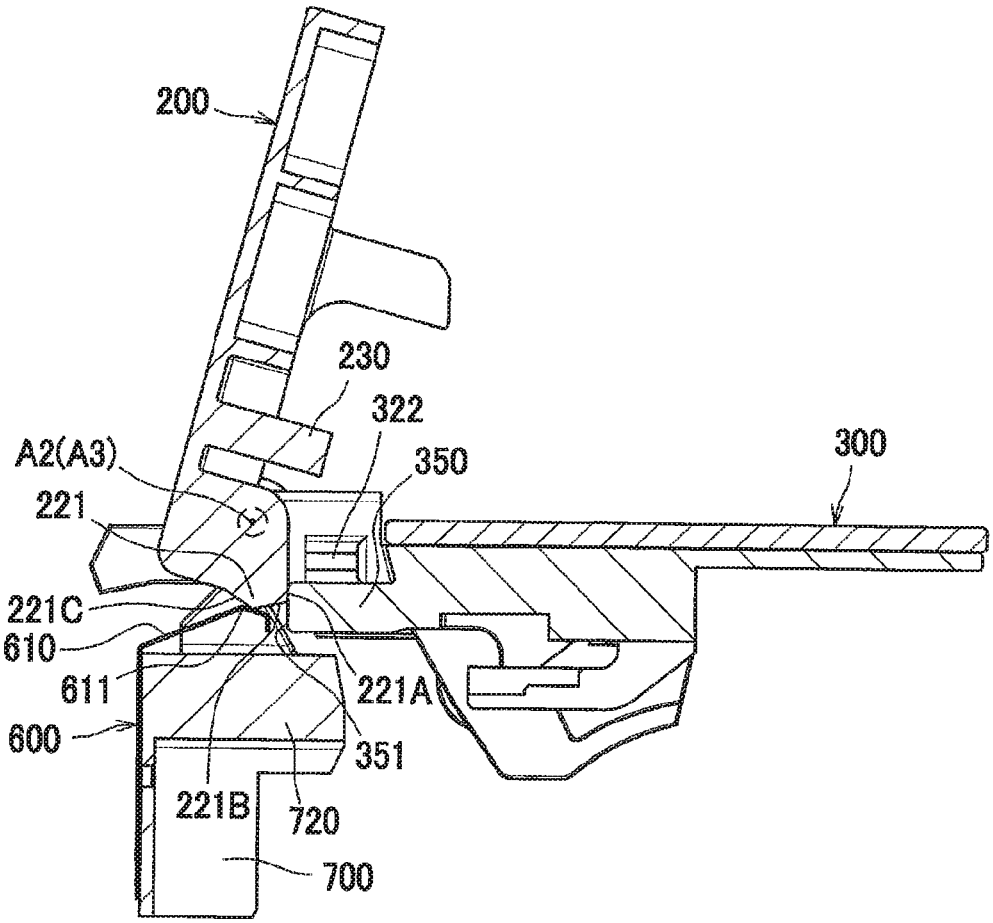
FIG. 14B is a cross-sectional view of the inner cover, the second outer cover, and the cover holding member taken along the plane passing through the first engaging portion and showing a state where the second outer cover is at a second opening position.

As illustrated in FIG. 14B, the first engagement portion 221 is disposed at the same position as the abutment wall 351 of the inner cover 300 in the leftward/rightward direction. That is, the abutment wall 351 is positioned frontward of the first leg portion 220 and is disposed on the rotation track of the first engagement portion 221 in a state where the second outer cover 200 is located at the second closing position and the inner cover 300 is located at the third closing position. Accordingly, since the abutment wall 351 is brought into abutment with the first engagement portion 221 when the second outer cover 200 is opened while the inner cover 300 is located at the third closing position, an open position of the second outer cover 200 is regulated.

Then, the abutment wall 351 is adapted to be retracted from the first engagement portion 221 when the inner cover 300 is opened (see FIG. 15B).

As illustrated in FIG. 12B, the first engagement portion 221 has a first surface 221A, a second surface 221B, and a third surface 221C. When the second outer cover 200 is located at the second opening position, the first surface extends in the upward/downward direction and faces forward, the second surface 221B extends backward and downward from the first surface 221A, and the third surface 221C extends backward and upward from the second surface 221B.

As illustrated in FIG. 11, the hook 230 is provided at both end portions of the cover body 210 in the leftward/rightward direction. The hook 230 includes an arm portion 231 and a claw portion 232. The arm portion 231 protrudes from the rear surface 210B of the cover body 210. The claw portion 232 protrudes outward in the leftward/rightward direction from the front end portion of the arm portion 231. As illustrated in FIG. 12A, the hook 230 is provided at such a position that the claw portion 232 is able to engage with the engaged groove 322 of the inner cover 300 while the second outer cover 200 is stacked on the inner cover 300. The hook 230 is an example of an engagement portion As illustrated in FIG. 11, the second outer cover 200 includes a pair of left and right operating portions 213. Each of the left and right operating portions 213 protrudes from the rear surface 210B.

As illustrated in FIG. 12A, the operating portion 213 is provided at a position corresponding to the insertion hole 311 while the inner cover 300 is stacked on the second outer cover 200. When the second outer cover 200 is located at the second closing position, the operating portion 213 enters the insertion hole 311 and acts on the target action portion 63D so that the switching member 63 is located at the first position. Then, as illustrated in FIG. 12B, when the second outer cover 200 is located at the second opening position, the operating portion 213 is positioned away from the target action portion 63D so that the switching member 63 is located at the second position. Specifically, when the second outer cover 200 is moved from the second opening position to the second closing position, the operating portion 213 presses the target action portion 63D downward so that the switching member 63 is pivotally moved from the first position toward the second position.

Next, a configuration of holding the second outer cover 200 and the inner cover 300 in an opened state will be described.

As illustrated in FIG. 3, a cover holding member 7 is provided in the left side wall 21 of the housing 2. As illustrated in FIG. 13C, the cover holding member 7 includes a leaf spring 600 and a holder 700 supporting the leaf spring 600.

Figure 13A:
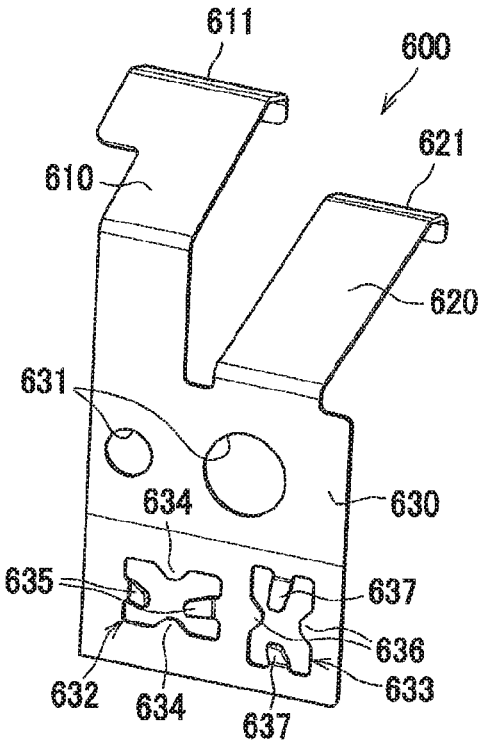
FIG. 13A is a perspective view of a leaf spring in the laser printer.

As illustrated in FIG. 13A, the leaf spring 600 has a shape in which the upper portion is divided into two parts, and includes a first arm 610, a second arm 620, and a connection portion 630. The second arm 620 is disposed leftward of the first arm 610. The connection portion 630 connects the first arm 610 and the second arm 620 to each other. That is, the first arm 610 and the second arm 620 are integrally formed with each other. In this way, since the first arm 610 and the second arm 620 are formed as a single component, the size of the apparatus can be reduced and the number of components thereof can be decreased.

The first arm 610 extends frontward and upward, and the front end portion thereof is provided with a first bent portion 611 which is bent downward. The second arm 620 extends frontward and upward, and the front end thereof is provided with a second bent portion 621 which is bent downward.

The second arm 620 is disposed downward of the first arm 610 in the upward/downward direction. Then, the second arm 620 is longer than the first arm 610. More specifically, the length of the second arm 620 from the connection portion 630 to the second bent portion 621 is longer than the length of the first arm 610 from the connection portion 630 to the first bent portion 611 (see FIG. 15A).

In this way, since the lengths of the first arm 610 and the second arm 620 are different from each other (the second arm 620 is longer than the first arm 610), the urging force of the second arm 620 can be decreased. Then, even when the first arm 610 and the second arm 620 have lengths different from each other, since the first arm 610 and the second arm 620 are disposed at different heights, the lengths of the first arm 610 and the second arm 620 can be changed in a manner such that the height of the boundary between the first arm 610 and the connection portion 630 and the height of the boundary between the second arm 620 and the connection portion 630 are changed. Accordingly, the leaf spring 600 can be obtained by bending a substantially rectangular metal plate. Further, since the material plate has a substantially rectangular shape before a bending process, efficient plate cutting can be obtained.

The connection portion 630 has a flat plate shape perpendicular to the frontward/rearward direction. Then, the connection portion 630 is formed in a substantial L-shape so as to connect the rear end of the first arm 610 and the rear end of the second arm 620 to each other. The connection portion 630 is formed with a pair of left and right holes 631. The connection portion 630 includes first and second positioning portions 632 and 633 which are formed below the pair of holes 631.

The first positioning portion 632 is formed with an opening penetrating the connection portion 630 in the thickness direction thereof. Then, the first positioning portion 632 includes a first positioning protrusion 634 and a first spring portion 635. The first positioning portion 632 protrudes inward in the upward/downward direction from the upper and lower edges of the opening. The first spring portion 635 extends inward in the leftward/rightward direction from the left and right edges of the opening.

The second positioning portion 633 is provided at the left portion of the first positioning portion 632. The second positioning portion 633 is formed with an opening penetrating the connecting portion 630 in the thickness direction thereof. Then, the second positioning portion 633 includes a second positioning protrusion 636 and a second spring portion 637. The second positioning protrusion 636 protrudes inward in the leftward/rightward direction from the left and right edges of the opening. The second spring portion 637 extends inward in the upward/downward direction from the upper and lower edges of the opening.

Figure 13B:
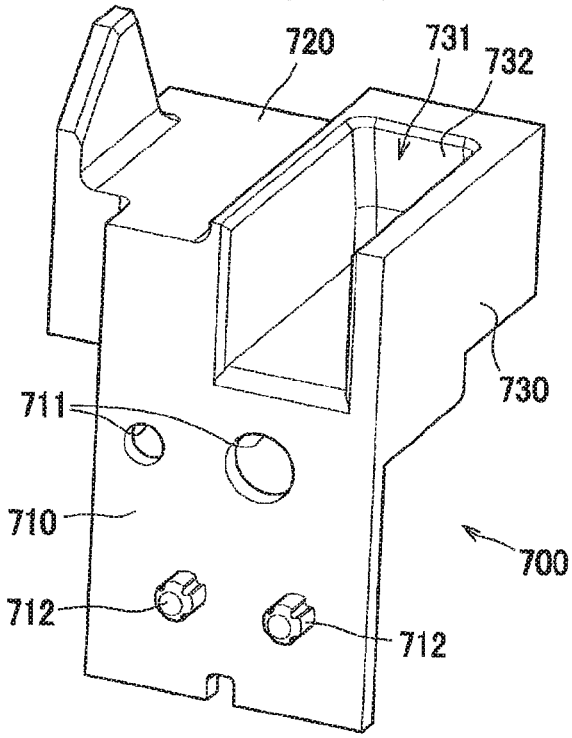
FIG. 13B is a perspective view of a holder in the laser printer.
Figure 13C:
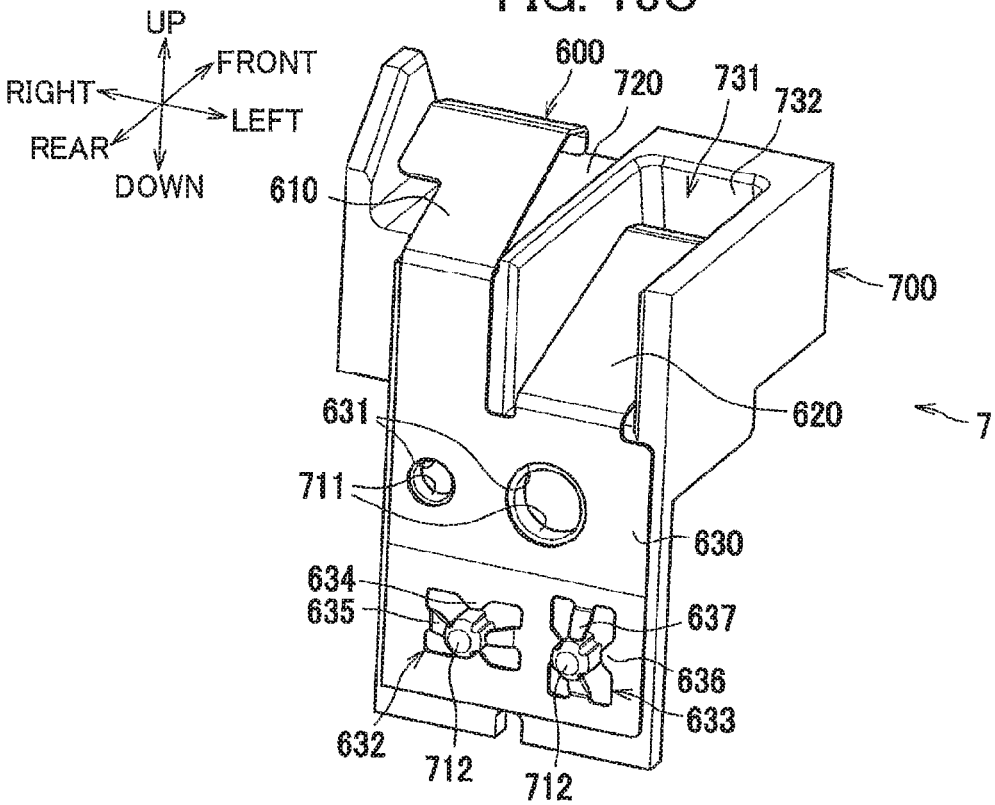
FIG. 13C is a perspective view of a cover holding member in the laser printer.

As illustrated in FIGS. 13B and 13C, the holder 700 includes a support wall 710, a first arm support portion 720, and a second arm support portion 730. The support wall 710 is disposed frontward of the connection portion 630 of the leaf spring 600. The first arm support portion 720 protrudes forward from the right end portion of the support wall 710 and is disposed below the first arm 610. The second arm support portion 730 protrudes forward from the left end portion of the support wall 710.

The second arm support portion 730 includes a concave portion 731 which is opened backward and upward. Then, the second arm 620 is disposed inside the concave portion 731.

The second arm support portion 730 includes a regulation wall 732 which is disposed frontward of the second arm 620 and is perpendicular to the frontward/rearward direction.

The support wall 710 is formed with a pair of holes 711. Each holes 711 is provided at the position corresponding to the hole 631 of the leaf spring 600. The support wall 710 includes a pair of left and right bosses 712 which is disposed below the pair of holes 711 and protrudes backward.

The right boss 712 is engaged with the first positioning portion 632 of the leaf spring 600. Specifically, the right boss 712 is in abutment with the pair of first positioning protrusions 634. Accordingly, the position of the leaf spring 600 with respect to the holder 700 in the upward/downward direction is fixed. Further, the right boss 712 is sandwiched in the leftward/rightward direction by the pair of first spring portions 635.

The left boss 712 is engaged with the second positioning portion 633 of the leaf spring 600 engages with. Specifically, the left boss 712 is in abutment with the pair of second positioning protrusions 636. Accordingly, the position of the leaf spring 600 with respect to the holder 700 in the leftward/rightward direction is fixed. Further, the left boss 712 is sandwiched in the upward/downward direction by the pair of second spring portions 637.

Then, the leaf spring 600 and the holder 700 are fixed to the housing 2 in a manner such that a screw (not illustrated) passing through the hole 631 of the leaf spring 600 and the hole 711 of the holder 700 is threadingly engaged with the housing 2.

As illustrated in FIG. 14A, the first arm 610 of the leaf spring 600 is disposed below the first leg portion 220 of the second outer cover 200, and the front end portion of the first arm 610 faces the abutment wall 351 of the inner cover 300. As illustrated in FIG. 14B, the first arm 610 sandwiches the first engagement portion 221 between the abutment wall 351 and the first arm 610 and urges the first engagement portion 221 toward the abutment wall 351 while the second outer cover 200 is located at the second opening position, thereby holding the second outer cover 200 in an opened state.

Then, as illustrated in FIG. 15A, the second arm 620 of the leaf spring 600 is disposed below the second leg portion 320 of the inner cover 300. As illustrated in FIG. 15C, the second arm 620 sandwiches the second engagement portion 340 between the regulation wall 732 and the second arm 620 and urges the second engagement portion 340 toward the regulation wall 732 while the inner cover 300 is located at the third opening position, thereby holding the inner cover 300 in an opened state.

Then, as illustrated in FIGS. 15B and 15C, the length from the third pivot axis A3 of the second engagement portion 340 to a portion (a corner of the first surface 341 and the second surface 342) engaging with the second arm 620 is longer than the length from the second pivot axis A2 of the first engagement portion 221 to a portion (a corner of the second surface 221B and the third surface 221C) engaging with the first arm 610. Accordingly, even when the first arm 610 and the second arm 620 are disposed at different heights, the first arm 610 can be engaged with the first engagement portion 221 and the second arm 620 can be engaged with the second engagement portion 340.

Next, an operation of opening and closing the second outer cover 200 and the inner cover 300 will be described. As illustrated in FIG. 14B, when the second outer cover 200 is raised from the second closing position toward the second opening position, the hook 230 is separated from the engaged groove 322 so that only the second outer cover 200 is pivotally moved.

Then, the first engagement portion 221 is moved past the first bent portion 611 while contacting the first arm 610 immediately before the second outer cover 200 pivotally moves to the second opening position. Then, when the second outer cover 200 is located at the second opening position, the first surface 221A of the first engagement portion 221 is brought into abutment with the abutment wall 351 of the inner cover 300 so that the pivotal movement of the second outer cover 200 is regulated. Then, at this time, the first bent portion 611 of the first arm 610 contacts the third surface 221C of the first engagement portion 221 and the first arm 610 urges the first engagement portion 221 toward the abutment wall 351 forward, so that the second outer cover 200 is held at the second opening position.

When the inner cover 300 is pivotally moved by a predetermined angle in a direction from the third closing position toward the third opening position after the second outer cover 200 is opened, the second outer cover 200 is stacked on the inner cover 300 at the second opening position as illustrated in FIG. 15B. At this time, the engaged groove 322 of the inner cover 300 is engaged with the hook 230 of the second outer cover 200. Accordingly, the second outer cover 200 and the inner cover 300 can be pivotally moved together.

Then, when the inner cover 300 pivotally moves from the third closing position toward the third opening position, the abutment wall 351 is retracted from the first engagement portion 221. Accordingly, the second outer cover 200 can be pivotally moved.

When the inner cover 300 is further pivotally moved, the second engagement portion 340 is moved past the second bent portion 621 of the second arm 620 while contacting the second arm 620 immediately before the inner cover 300 is located at the third opening position. Then, as illustrated in FIG. 15C, the third surface 343 of the second engagement portion 340 contacts the regulation wall 732, thereby regulating an open position of the inner cover 300 is opened. That is, the pivotal movement of the inner cover 300 is regulated at the third opening position. Then, at this time, the second arm 620 contacts the first surface 341 of the second engagement portion 340 so as to urge the second engagement portion 340 toward the regulation wall 732, so that the inner cover 300 is held at the third opening position.

Figure 16:
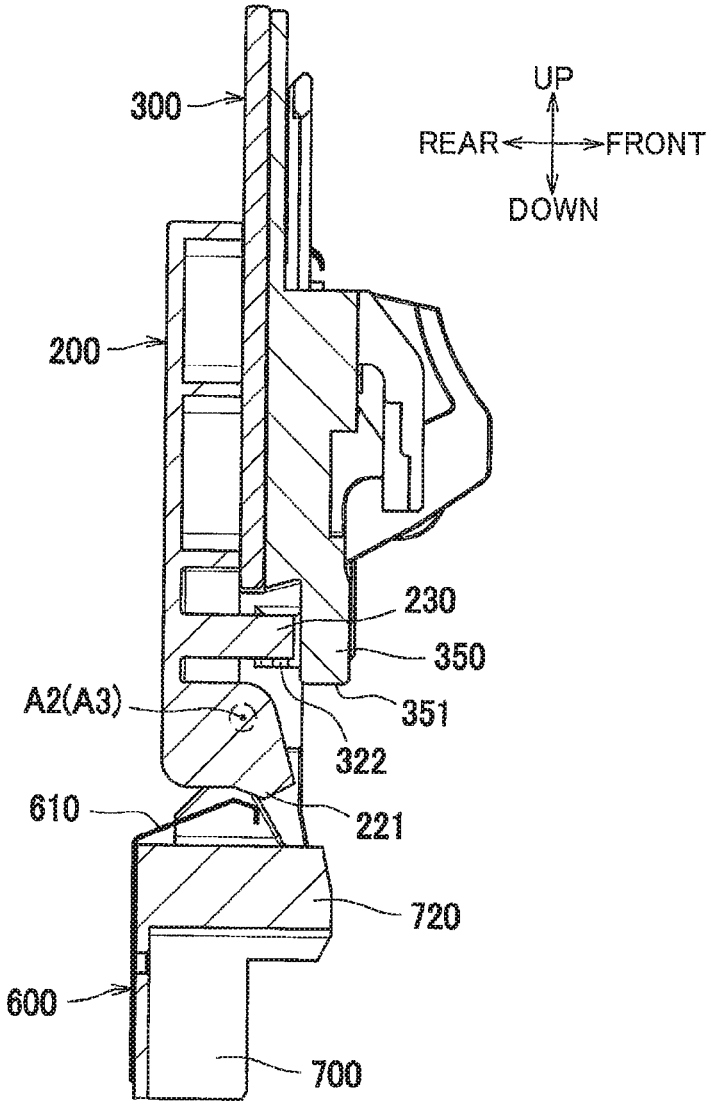
FIG. 16 is a cross-sectional view of the inner cover, the second outer cover, and the cover holding member taken along the plane passing through the first engaging portion in a state where the inner cover is at the third opening position.

Meanwhile, as illustrated in FIG. 16, since the first engagement portion 221 pivotally moves to move away from the first arm 610 in accordance with the pivotal movement of the inner cover 300. Accordingly, any urging force is not transmitted to the first engagement portion 221 from the first arm 610 while the inner cover 300 is located at the third opening position. In this way, since the first engagement portion 221 does not receive an urging force from the first arm 610 and a force with which the second arm 620 urges the second engagement portion 340 decreases as described above, the inner cover 300 can be opened and closed by a weak force.

Figure 17:
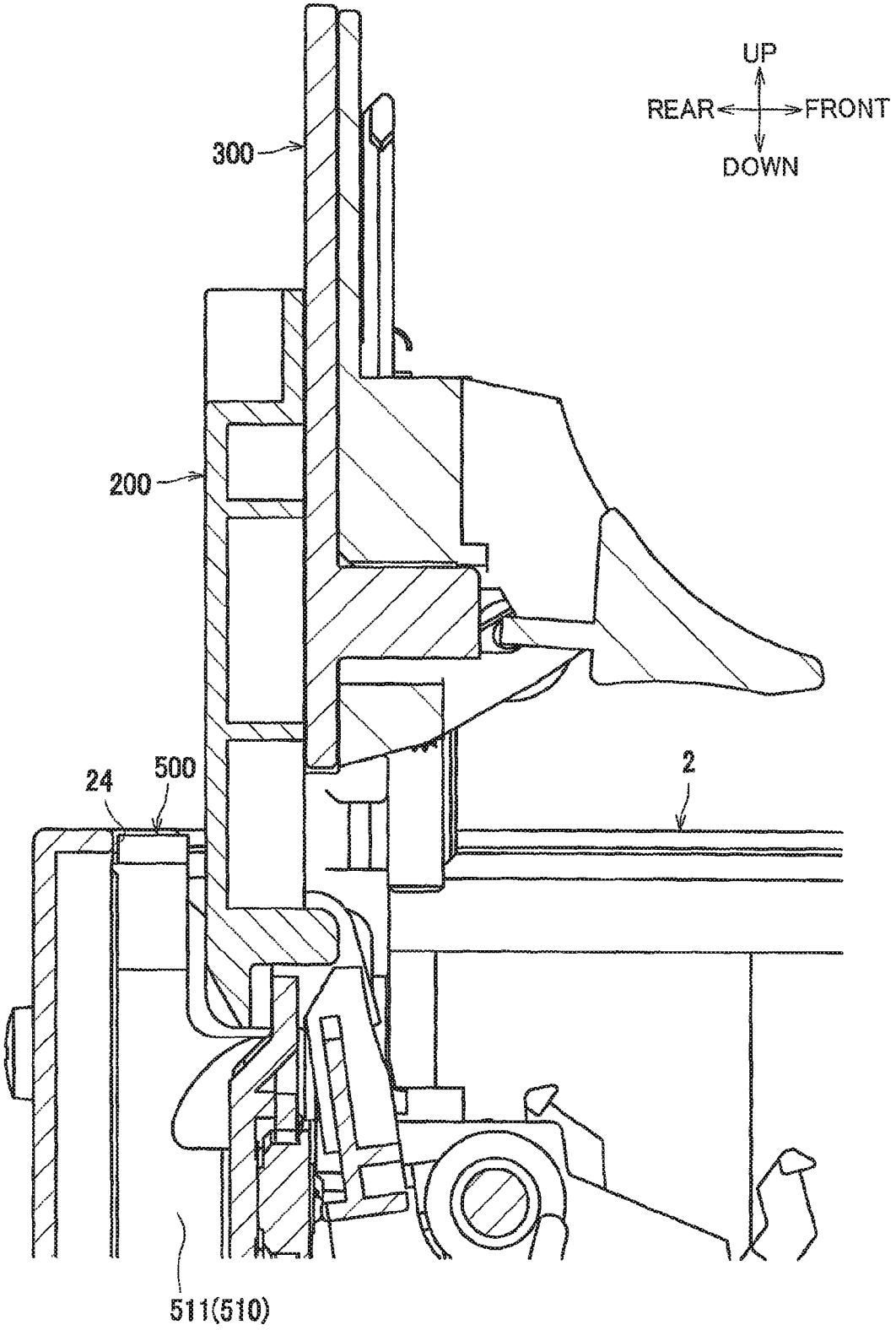
FIG. 17 is a cross-sectional view for description of positional relationship between the second outer cover and the side guide, when the inner cover is at the third opening position.

As illustrated in FIG. 17, when the inner cover 300 is located at the third opening position, the regulation portion 510 of the side guide 500 faces the rear side of the second outer cover 200. Accordingly, when the second outer cover 200 and the inner cover 300 fall backward, the side guide 500 is brought into abutment with the second outer cover 200 and the inner cover 300, thereby regulating the open positions of the second outer cover 200 and the inner cover 300.

The operation of the laser printer 1 with the above-described configuration will be described. As illustrated in FIG. 4, when a printing operation is performed while the sheet S is inserted from the first sheet supply opening 24, the first outer cover 100 is opened to the first opening position while the second outer cover 200 is closed. At this time, as illustrated in FIG. 12A, since the operating portion 213 of the second outer cover 200 applies a force to the target action portion 63D of the switching member 63, the switching member 63 is held at the first position. Accordingly, as illustrated in FIG. 4, the sheet S on which an image has been formed by the image forming unit 4 is guided toward the first discharge roller 61 by the switching member 63 and is discharged to the outside of the housing 2 by the first discharge roller 61. The sheet S discharged by the first discharge roller 61 is supported by the sheet discharging tray 28 and the first outer cover 100 positioned at the first opening position.

When a printing operation is performed on the sheet S having high stiffness such as hard thick paper, the sheet S is inserted from the second sheet supply opening 25. At this time, the second outer cover 200 is opened at the second opening position. At this time, as illustrated in FIG. 12B, since the operating portion 213 of the second outer cover 200 is retracted from the target action portion 63D of the switching member 63, the switching member 63 is automatically switched to the second position. Accordingly, as illustrated in FIG. 4, the sheet S on which an image has been formed by the image forming unit 4 is guided toward the second discharge roller 62 by the switching member 63 and is discharged to the outside of the housing 2 by the second discharge roller 62.

At this time, since the tangential line L of the first roller 62A and the second roller 62B passing through the contact point between the first roller 62A and the second roller 62B of the second discharge roller 62 is inclined backward with respect to the upward/downward direction, the sheet S discharged by the second discharge roller 62 advances obliquely backward and upward. Then, the sheet S discharged by the second discharge roller 62 contacts the second outer cover 200 positioned at the second opening position so that the sheet S advances obliquely forward and upward.

Accordingly, since the sheet S is discharged forward both when the sheet S is discharged by the first discharge roller 61 and when the second discharge roller 62, a user easily takes the discharged sheet S.

In the embodiment, the second outer cover 200 positioned at the second opening position contacts the sheet S discharged by the second discharge roller 62 and guides the sheet S in a direction opposite to the discharge direction of the second discharge roller 62. With this configuration, if the sheet S is curled caused by passing through the second discharge roller 62 after passing through the fixing unit 5, this curl of the sheet S can be corrected.

Further, in the embodiment, a sheet discharged from the first discharge roller 61 is supported by the first outer cover 100 and a sheet discharged from the second discharge roller 62 is guided by the second outer cover 200. That is, the conveyance destination of the sheet depends on the discharge roller used for discharging the sheet. Consequently, facilitated access to the discharged sheet can be obtained.

Further, in the embodiment, when the engaged groove 322 of the inner cover 300 is engaged with the hook 230 of the second outer cover 200, the second outer cover 200 and the inner cover 300 can be pivotally moved together. Accordingly, both the second outer cover 200 and the inner cover 300 can be easily closed by closing either the second outer cover 200 or the inner cover 300.

Further, in the embodiment, when the inner cover 300 is opened, the switching member 63 is moved together with the inner cover 300 to be positioned outside of housing 2 since the switching member 63 is attached to the inner cover 300. Thus, the sheet S jammed in the housing 2 can be easily extracted.

Further, in the embodiment, the switching member 63 is automatically switched to the second position when the second outer cover 200 is opened, and is automatically switched to the first position when the second outer cover 100 is closed.

While the description has been made in detail with reference to the embodiment thereof, it would be apparent to those skilled in the art that many modifications and variations may be made therein without departing from the spirit of the present disclosure.

In the above-described embodiment, the second outer cover 200 is inclined forward with respect to the upward/downward direction while being located at the second opening position, but the configuration of the second outer cover 200 is not limited to this. For example, the second outer cover 200 may be inclined backward with respect to the upward/downward direction while being located at the second opening position.

In the above-described embodiment, the second discharge roller 62 is disposed so that the tangential line L of the first roller 62A and the second roller 62B at the contact point between the first roller 62A and the second roller 62B of the second discharge roller 62 is inclined backward with respect to the upward/downward direction, but the configurations of the second discharge roller 62 is not limited thereto. For example, the second discharge roller 62 may be disposed so as to convey the sheet S upward vertically.

In the above-described embodiment, the side guide 500 is supported by the support wall 26 disposed at the front side of the side guide 500, but the configuration of the side guide is not limited thereto. For example, the side guide may be supported by the rear wall 22 disposed at the rear side of the side guide 500.

In the above-described embodiment, the first outer cover 100 and the second outer cover 200 constitutes the upper surface of the apparatus when the second outer cover 200 and the inner cover 300 is at the second closing position and the third closing position, respectively, but the configurations of the second outer cover 200 and the inner cover 300 are not limited to these configurations. For example, the second outer cover 200 and the inner cover 300 may constitute the side surface of the apparatus when the second outer cover 200 and the inner cover 300 is at the second closing position and the third closing position, respectively.

In the above-described embodiment, the holder 700 is a component separated from the side wall 21 of the housing 2, but the configuration of the holder 700 is not limited thereto. For example, the holder 700 may be formed in the side wall 21.

What is claimed is:

1. An image forming device comprising:

a housing;

a first discharge roller disposed at an upper portion of an interior of the housing and configured to discharge a sheet out of the housing;

a second discharge roller disposed at the upper portion of the interior of the housing and configured to discharge a sheet out a top surface of the housing, the second discharge roller having a part overlapped with the first discharge roller in a perpendicular direction perpendicular to an axial direction of the first discharge roller and to a vertical direction;

a first cover pivotally movable relative to the housing about a first pivot axis extending in the axial direction between a first closing position and a first opening position, the first cover being positioned above the first discharge roller and constituting a part of the top surface of the housing when the first cover is at the first closing position, and the first cover allowing the first discharge roller to be exposed to an outside and supporting the sheet discharged from the first discharge roller when the first cover is at the first opening position; and a second cover pivotally movable relative to the housing about a second pivot axis extending in the axial direction between a second closing position and a second opening position, the second cover covering an upper portion of the second discharge roller and constituting the top surface of the housing next to the first cover positioned at the first closing position when the second cover is at the second closing position, the second cover allowing the second discharge roller to be exposed to the outside and guiding the sheet discharged from the second discharge roller when the second cover is at the second opening position, the first cover having one end portion and another end portion in the perpendicular direction, and the second cover having one end portion and another end portion in the perpendicular direction, the one end portion of the first cover being positioned farther from the second cover than the another end portion of the first cover from the second cover when the first cover is at the first closing position, and the another end portion of the second cover being positioned farther from the first cover than the one end portion of the second cover from the first cover when the second cover is at the second closing position, the first pivot axis being positioned at the one end portion of the first cover, and the second pivot axis being positioned at the another end portion of the second cover.

2. The image forming device as claimed in claim 1, wherein the first cover and the second cover have lengths in the perpendicular direction, the length of the first cover being greater than that of the second cover.

3. The image forming device as claimed in claim 1, further comprising:

a fixing unit disposed at the upper portion of the interior of the housing and configured to fix a developing agent image onto the sheet; and a third cover pivotally movable relative to the housing about a third pivot axis extending in the axial direction between a third closing position and a third opening position, the third cover being positioned above the fixing unit to cover the fixing unit when the third cover is at the third closing position, and the third cover allowing the fixing unit to be exposed to the outside when the third cover is at the third opening position, the first cover and the second cover providing a boundary when the first cover and the second cover are at the first closing position and the second closing position, respectively, and the boundary being overlapped with the third cover when viewed from the vertical direction.

4. The image forming device as claimed in claim 3, wherein the housing has one end and another end in the perpendicular direction, the one end of the housing being closer to the one end portion of the first cover than the another end of the housing to the one end portion of the first cover when the first cover is at the first closing position; and wherein the third cover has one end and another end in the perpendicular direction, the one end of the third cover being positioned closer to the one end of the housing than the another end of the third cover to the one end of the housing when the third cover is at the third closing position; and the image forming device further comprising a support frame positioned above the first discharge roller and configured to support the first discharge roller, the support frame having one end and another end in the perpendicular direction, the one end of the support frame being positioned closer to the one end of the housing than the another end of the support frame to the one end of the housing, the one end of the third cover being aligned with the one end of the support frame in the vertical direction.

5. The image forming device as claimed in claim 3, wherein the third cover has one end portion and another end portion in the perpendicular direction, the one end portion of the third cover being positioned closer to the one end of the housing than the another end portion of the third cover to the one end of the housing when the third cover is at the third closing position, the third pivot axis being positioned at the another end portion of the third cover;

wherein the second cover and the third cover are positioned to be overlapped with each other in the vertical direction when the second cover and the third cover are at the second closing position and the third closing position, respectively;

wherein the second cover has an engagement portion; and wherein the third cover has an engaged portion configured to be engaged with the engagement portion upon pivotal movement of the third cover by a predetermined angle in a direction from the third closing position toward the third opening position.

6. The image forming device as claimed in claim 5, wherein the housing is formed with a sheet supply opening positioned between the another end of the housing and the second cover; and wherein the housing is provided with a side guide positioned inside the sheet supply opening to regulate a position of the sheet in its widthwise direction, the side guide being abuttable on the second cover so as to regulate an open position of the second cover when the second cover is pivotally moved from the second opening position in a direction opposite to a direction from the second opening position toward the second closing position.

7. The image forming device as claimed in claim 3, further comprising a change-over member supported the third cover, and configured to be selectively moved between a first position to guide the sheet toward the first discharge roller and a second position to guide the sheet toward the second discharge roller.

8. The image forming device as claimed in claim 7, wherein the second cover is provided with an operating portion acting on the change-over member to position the change-over member at the first position when the second cover is at the second closing position, the operating portion being positioned away from the change-over member to permit the change-over member to be moved to the second position when the second cover is at the second opening position.

9. The image forming device as claimed in claim 1, wherein the housing has one end and another end in the perpendicular direction, the one end of the housing being closer to the one end portion of the first cover than the another end of the housing to the one end portion of the first cover when the first cover is at the first closing position; and wherein the entirety of the second cover is positioned toward the one end of the housing relative to the another end of the housing when the second cover is at the second opening position.

10. The image forming device as claimed in claim 1, wherein the housing has one end and another end in the perpendicular direction, the one end of the housing being closer to the one end portion of the first cover than the another end of the housing to the one end portion of the first cover when the first cover is at the first closing position; and wherein the second cover is configured to be supported so as to be tilted toward the one end of the housing with respect to the vertical direction when the second cover is at the second opening position.

11. The image forming device as claimed in claim 1, wherein the housing has one end and another end in the perpendicular direction, the one end of the housing being closer to the one end portion of the first cover than the another end of the housing to the one end portion of the first cover when the first cover is at the first closing position;

wherein the first cover is tilted toward the one end of the housing with respect to the vertical direction when the first cover is at the first opening position; and wherein the second cover is tilted toward the one end of the housing with respect to the vertical direction when the second cover is at the second opening position.

12. The image forming device as claimed in claim 11, further comprising:

an image forming unit provided in the interior of the housing and configured to form a developing agent image on the sheet; and a fixing unit provided in the interior of the housing and configured to fix the developing agent image to the sheet;

wherein the second pivot axis of the second cover is positioned closer to the another end of the housing than the second discharge roller to the another end of the housing; and wherein the second discharge roller comprises a first roller and a second roller configured to nip the sheet in cooperation with the first roller, the first roller and the second roller providing a tangential line passing through a contact point between the first roller and the second roller, the tangential line being inclined toward the another end of the housing with respect to the vertical direction and, the tangential line crossing the second cover when the second cover is at the second opening position.

13. The image forming device as claimed in claim 12, wherein a first sheet supply opening is positioned close to the another end portion of the second cover and allows the sheet to be inserted so as to convey the sheet toward the image forming unit.

14. The image forming device as claimed in claim 13, wherein the second cover has an inclined surface at the another end portion of the second cover, the inclined surface being inclined toward the one end portion of the second cover in a state where the second cover is at the second closing position.

15. The image forming device as claimed in claim 14, wherein the housing is provided with a side guide positioned inside the first sheet supply opening to regulate a position of the sheet in its widthwise direction, the side guide having a guide surface extending toward the another end of the housing, the inclined surface having an end close to the another end of the housing, and the end of the inclined surface being overlapped with the guide surface when viewed from the vertical direction.

16. The image forming device as claimed in claim 13, wherein the first sheet supply opening having one end and another end in the perpendicular direction, the one end of the first sheet supply opening being closer to the one end of the housing than the another end of the first sheet supply opening to the one end of the housing;

wherein the housing is provided with a wall positioned at a side of the one end of the first sheet supply opening, the side guide being supported by the wall so as to be movable in a widthwise direction of the sheet.

17. The image forming device as claimed in claim 13, further comprising a U-turn guide configured to guide the sheet conveyed from the first sheet supply opening toward one end of the housing and downward, and then guide the sheet toward the another end of the housing and upward to convey the sheet to the image forming unit.

18. The image forming device as claimed in claim 17, wherein the one end of the housing has a lower end portion formed with a second sheet supply opening communicating with the U-turn guide, the second sheet supply opening allowing the sheet to pass therethrough to convey the sheet toward the image forming unit.

19. The image forming device as claimed in claim 13, wherein the one end of the housing has a lower end portion formed with a second sheet supply opening, the second sheet supply opening allowing the sheet to pass therethrough to convey the sheet toward the image forming unit.

* * * * *